US009905927B2

(12) United States Patent
Yanagi et al.

(10) Patent No.: US 9,905,927 B2
(45) Date of Patent: Feb. 27, 2018

(54) ANTENNA DEVICE, CIRCUIT BOARD AND MEMORY CARD

(71) Applicant: FUJITSU COMPONENT LIMITED, Tokyo (JP)

(72) Inventors: Masahiro Yanagi, Tokyo (JP); Shigemi Kurashima, Tokyo (JP); Hideaki Yoda, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/178,731

(22) Filed: Jun. 10, 2016

(65) Prior Publication Data

US 2016/0301137 A1 Oct. 13, 2016

Related U.S. Application Data

(62) Division of application No. 13/417,513, filed on Mar. 12, 2012, now Pat. No. 9,391,358.

(30) Foreign Application Priority Data

Mar. 29, 2011 (JP) ..... 2011-073642

(51) Int. Cl.

| | |
|---|---|
| ***H01Q 9/04*** | (2006.01) |
| ***H01Q 1/24*** | (2006.01) |
| ***H01Q 9/42*** | (2006.01) |
| ***H01Q 1/48*** | (2006.01) |

(52) U.S. Cl.

CPC ..... *H01Q 9/04* (2013.01); *H01Q 1/24* (2013.01); *H01Q 1/48* (2013.01); *H01Q 9/42* (2013.01)

(58) Field of Classification Search

CPC ..... H01Q 9/42; H01Q 9/30

See application file for complete search history.

(56) References Cited

U.S. PATENT DOCUMENTS

| | | | | |
|---|---|---|---|---|
| 3,845,490 | A | 10/1974 | Manwarren et al. | |
| 6,404,395 | B1 | 6/2002 | Masuda | |
| 7,023,909 | B1 | 4/2006 | Adams et al. | |
| 7,026,999 | B2 | 4/2006 | Umehara et al. | |
| 7,466,277 | B2 | 12/2008 | Ishizuka et al. | |
| 2001/0043159 | A1* | 11/2001 | Masuda | H01Q 1/38 343/700 MS |
| 2002/0034966 | A1 | 3/2002 | Saito et al. | |
| 2002/0154063 | A1 | 10/2002 | Klaavo et al. | |
| 2004/0196188 | A1 | 10/2004 | Yeh | |
| 2004/0246180 | A1 | 12/2004 | Okado | |
| 2006/0208949 | A1 | 9/2006 | Hirabayashi | |
| 2007/0052591 | A1 | 3/2007 | Chao | |
| 2008/0309562 | A1 | 12/2008 | Tsutsumi et al. | |
| 2009/0051606 | A1 | 2/2009 | Ochi et al. | |
| 2009/0224981 | A1 | 9/2009 | Shibata | |

(Continued)

FOREIGN PATENT DOCUMENTS

| | | |
|---|---|---|
| JP | H06-069715 | 3/1994 |
| JP | 2001-266098 | 9/2001 |

(Continued)

*Primary Examiner* — Daniel J Munoz
(74) *Attorney, Agent, or Firm* — IPUSA, PLLC

(57) ABSTRACT

A disclosed antenna device includes a substrate made of a dielectric material, an antenna element formed on one side of the substrate, and a ground element formed on another side of the substrate.

5 Claims, 28 Drawing Sheets

(56) References Cited

U.S. PATENT DOCUMENTS

| | | | | |
|---|---|---|---|---|
| 2009/0231214 | A1* | 9/2009 | Mukouyama | H01Q 1/243 343/702 |
| 2009/0237309 | A1* | 9/2009 | Ohba | H01Q 1/243 343/700 MS |
| 2010/0231477 | A1 | 9/2010 | Kuramoto et al. | |
| 2011/0009078 | A1 | 1/2011 | Kawamura | |
| 2011/0012805 | A1 | 1/2011 | Huang | |
| 2011/0122038 | A1* | 5/2011 | Koide | H01Q 9/0407 343/803 |
| 2011/0128193 | A1 | 6/2011 | Arimuira et al. | |

FOREIGN PATENT DOCUMENTS

| | | | |
|---|---|---|---|
| JP | 2002-076735 | | 3/2002 |
| JP | 2002-084134 | | 3/2002 |
| JP | 2003-218623 | | 7/2003 |
| JP | 2003218623 | A * | 7/2003 |
| JP | 2006-018624 | | 1/2006 |
| JP | 2006-191270 | | 7/2006 |
| JP | 2007-299338 | | 11/2007 |
| JP | 2008-083868 | | 4/2008 |
| JP | 2011-022640 | | 2/2011 |
| WO | 2006/134701 | | 12/2006 |
| WO | 2007/125948 | | 11/2007 |
| WO | 2008/038756 | | 4/2008 |

* cited by examiner

| | MEMORY CARD WITH ANTENNA OF EMBODIMENT | MEMORY CARD WITH ANTENNA OF EXAMPLE |
|---|---|---|
| DIGITAL CAMERA A | −53.2 dB to −42.1 dB | −52.7 dB to −43.7 dB |
| DIGITAL CAMERA B | −52.7 dB to −40.2 dB | −54.3 dB to −48.0 dB |

ANTENNA DEVICE, CIRCUIT BOARD AND MEMORY CARD

CROSS-REFERENCE TO RELATED APPLICATIONS

This patent application is a divisional application of and claims the benefit of priority under 35 U.S.C. 120 to the patent application Ser. No. 13/417,513 filed on Mar. 12, 2012, which was based upon and claims the benefit of priority of Japanese Patent Application No. 2011-073642 filed on Mar. 29, 2011, the entire contents of which are incorporated herein by reference.

BACKGROUND OF THE INVENTION

1. Field of the Invention

The present invention generally relates to an antenna device, a circuit board and a memory card.

2. Description of the Related Art

An image, a video or the like is captured by a camera or the like, and the captured image, the video or the like may be stored in a recording medium installed in the camera or the like. However, because the recording medium is ordinarily installed inside the camera, there is an upper limit in a memory capacity. Therefore, an image or a video having a predetermined period of time or longer may not be stored in the camera.

In order to transfer information to a recording medium having a large capacity from a camera, an antenna for wireless communication is installed inside the camera. For example, a memory card in which an antenna for wireless communication is installed may be used.

Problems to be Solved by the Invention

When such a memory card is installed in the camera or the like, the antenna does not ordinarily protrude from the body of the camera or the like. For example, a camera body includes a metallic case and a memory card may be surrounded by the metallic case and further by an electronic circuit board including a conductive portion. Therefore, when the memory card having the antenna is installed in the camera, it may be difficult to send information by wireless communication from the inside of the camera to the outside of the camera. In this case, the information may not be accurately sent, or a spatial area where the information can be sent may be limited.

[Patent Document 1] Japanese Laid-open Patent Publication No. 2001-266098

[Patent Document 2] Japanese Laid-open Patent Publication No. 2006-18624

[Patent Document 3] Japanese Laid-open Patent Publication No. 2007-299338

[Patent Document 4] Japanese Laid-open Patent Publication No. 2008-83868

[Patent Document 5] Japanese Laid-open Patent Publication No. 2011-22640

[Patent Document 6] International Publication Pamphlet No. 2007/125948

[Patent Document 7] International Publication Pamphlet No. 2008/038756

SUMMARY OF THE INVENTION

Accordingly, embodiments of the present invention may provide a novel and useful antenna device, a circuit board and a memory card solving one or more of the problems discussed above.

More specifically, the embodiments of the present invention may provide a high communication performance even if the antenna device, the circuit board and the memory card are installed inside cases of information technology devices.

An aspect of the present invention may be to provide an antenna device including a substrate made of a dielectric material; an antenna element formed on one side of the substrate; and a ground element formed on another side of the substrate.

Another aspect of the present invention may be to provide an antenna device including a substrate made of a dielectric material; an antenna element formed on one side of the substrate; and a ground element formed on another side of the substrate.

Another aspect of the present invention may be to provide the antenna device, wherein a shape of the antenna element and a shape of the ground element are substantially symmetrical with respect to the substrate.

Another aspect of the present invention may be to provide the antenna device, wherein a position of the antenna element and a position of the ground element are substantially symmetrical with respect to the substrate.

Another aspect of the present invention may be to provide the antenna device, wherein a position of the antenna element and a position of the ground element are do not overlap through to the substrate.

Another aspect of the present invention may be to provide the antenna device, wherein the antenna element and the ground element are in an inverse L shape.

Another aspect of the present invention may be to provide the antenna device, wherein the antenna element is connected to the ground element via a through hole formed in the substrate.

Another aspect of the present invention may be to provide the antenna device, wherein the antenna element is in an inverse F shape, and the ground element substantially occupies a surface on the other side of the substrate in its entirety.

Another aspect of the present invention may be to provide the antenna device, wherein a shape of the antenna element and a shape of the ground element are a meander pattern.

Another aspect of the present invention may be to provide the antenna device, wherein the substrate is a printed-wiring board.

Another aspect of the present invention may be to provide the antenna device, wherein an inductor for adjusting a resonance frequency is connected to the antenna element and the ground element.

Another aspect of the present invention may be to provide the antenna device, wherein the substrate is a multi-layered printed-wiring board, and one or both of the antenna element and the ground element are formed inside the printed-wiring board.

Another aspect of the present invention may be to provide the antenna device, wherein the substrate is a multi-layered printed-wiring board, the antenna element includes a first antenna element formed inside the printed-wiring board and a second antenna element formed on the other side of the printed-wiring board, and an antenna element connecting portion formed inside a through hole; the ground element includes a first ground element formed inside the printed-wiring board and a second ground element formed on the other side of the printed-wiring board, and a ground element connecting portion formed inside another through hole.

Another aspect of the present invention may be to provide the antenna device, wherein the first antenna element and the first ground element are formed in a region where the second antenna element overlaps the second ground element through a thickness of the substrate.

Another aspect of the present invention may be to provide the antenna device, wherein any one of the first antenna element, the second antenna element, the first ground element and the second ground element does not overlap another one of the first antenna element, the second antenna element, the first ground element and the second ground element through a thickness of the substrate.

Another aspect of the present invention may be to provide the antenna device, wherein the antenna device is configured to be used in a frequency range of 2.4 GHz to 2.5 GHz.

Another aspect of the present invention may be to provide the antenna device, wherein the antenna device is used for wireless LAN or Bluetooth.

Another aspect of the present invention may be to provide a circuit board including an antenna device including a first printed-wiring board made of a dielectric material; an antenna element formed on one side of the first printed-wiring board; and a ground element formed on another side of the first printed-wiring board; and a second printed-wiring board on which a ground area is formed, wherein the ground element is connected to the ground area.

Another aspect of the present invention may be to provide the circuit board, wherein the ground element is formed on a second printed-wiring board instead of the first printed-wiring board.

Another aspect of the present invention may be to provide the circuit board, wherein the second printed-wiring board has an electronic component mounted on the second printed-wiring board.

Another aspect of the present invention may be to provide a memory card including a circuit board including a substrate made of a dielectric material; an antenna element formed on one side of the substrate; and a ground element formed on another side of the substrate; and a case configured to cover the circuit board.

Additional objects and advantages of the embodiments are set forth in part in the description which follows, and in part will become obvious from the description, or may be learned by practice of the invention. The objects and advantages of the invention will be realized and attained by means of the elements and combinations particularly pointed out in the appended claims. It is to be understood that both the foregoing general description and the following detailed description are exemplary and explanatory and are not restrictive of the invention as claimed.

DETAILED DESCRIPTION OF THE PREFERRED EMBODIMENTS

A description of embodiments of the present invention is given below, with reference to the FIG. 1 through FIG. 40. The same reference symbols are attached to the same components or the like and description of the components is omitted.

The reference symbols typically designate as follows:

100: antenna device;
110: printed-wiring board;
120: antenna element;
130: ground element;
200: circuit board;
210: ground area;
211: printed-wiring board;
212: external connection terminal;
250: memory card;
260: first case;
262: opening portion; and
270: second case.

First Embodiment (Antenna Device and Circuit Board)

Figure 1:
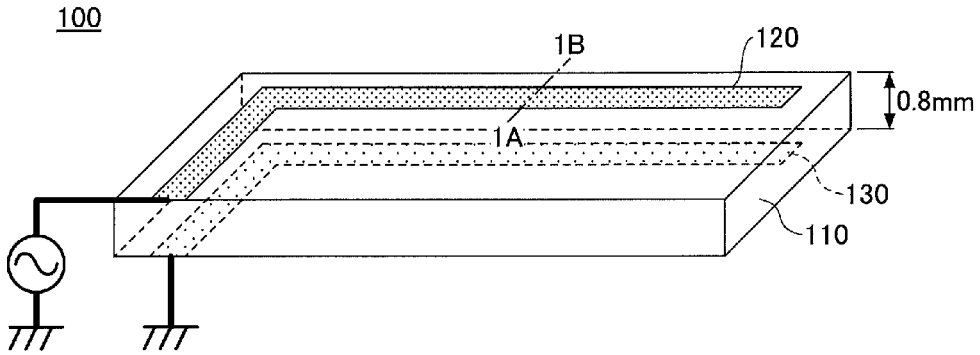
FIG. 1 illustrates a structure of an antenna device of a First Embodiment.

The antenna device and the circuit board of the First Embodiment are described. Referring to FIG. 1, the antenna device 100 of the First Embodiment has an antenna element 120 on one side of a substrate such as a printed-wiring board 110, and a ground element 130 on the other side of the substrate. The sides are determined relative to a thickness center of the substrate such as the printed-wiring board 110.

The antenna element 120 and the ground element 130 are made of a metallic material such as copper. The antenna element 120 and the ground element 130 are symmetrical with respect to the printed-wiring board 110. The ground element 130 of the antenna device 100 is grounded, and a high-frequency voltage of, for example, 2.4 GHz to 2.5 GHz is applied to the antenna element 12.

The antenna device of the First Embodiment may be used for communications in a frequency range of 2.4 GHz to 2.5 GHz, in wireless LAN or in Bluetooth (BT) ("Bluetooth" is a registered trademark). In the antenna device of the First Embodiment, inductors having predetermined inductances may be connected to the antenna element 120 and the ground element 130, respectively, in order to adjust a resonance frequency.

Within the First Embodiment, the printed-wiring board 110 is made of a glass epoxy resin having a thickness of about 0.8 mm. For example, the printed wiring board 110 includes a FR4 substrate whose relative permittivity $\in_r$ is about 4.7. The antenna element 120 and the ground element 130 are formed to have an inverse L shape (hereinafter, it may be referred to as an inverse L type) so as to be substantially symmetrical with respect to the printed wiring board. Specifically, patterns of the antenna element 120 and the ground element 130 may be formed in a similar manner to a case where the wiring pattern made of copper is formed. Meanwhile, in the First Embodiment, a case where the printed-wiring board 110 is used is described. However, a board made of another dielectric material such as a ceramics board formed by AlN, $Al_2O_3$ or the like and a plastic board may be used.

Figure 2:
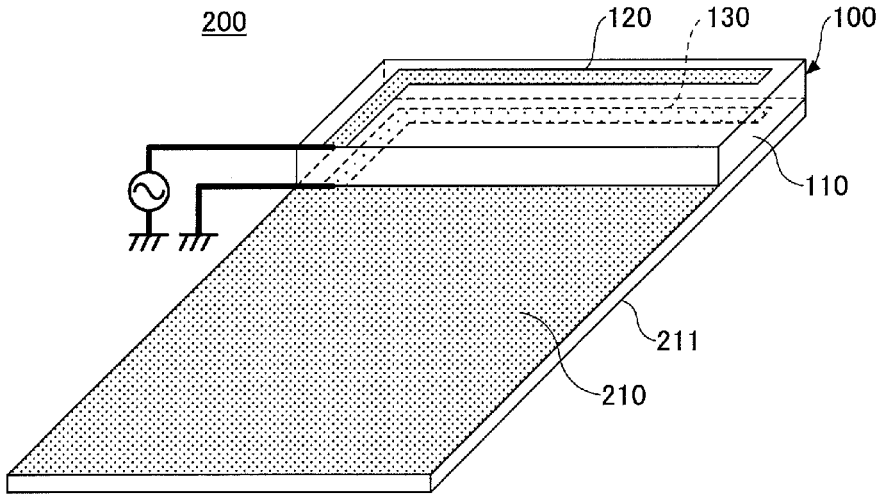
FIG. 2 illustrates a structure of a circuit board of the First Embodiment.

Referring to FIG. 2, the circuit board 200 includes an antenna device 100 of the First Embodiment. Specifically, a ground (GND) area 210 is formed on a surface of a printed-wiring board 211 forming the circuit board 200 and the ground area 210 is grounded. Further, the ground area 210 is connected to the ground element 130 of the antenna 100. Within the First Embodiment, the circuit board such as the circuit board 200 has the antenna device 100.

Figure 3:
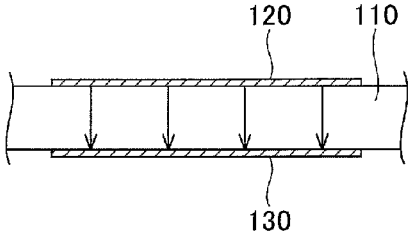
FIG. 3 schematically illustrates a part of the antenna device of the First Embodiment.

Next, a positional relationship between the antenna element 120 and the ground element 130 in the antenna device 100 of the First Embodiment is described. FIG. 3 illustrates a part of a cross-section cut along a dot chain line 1A-1B in FIG. 1. Referring to FIG. 3, the antenna element 120 and the ground element 130 are formed on both surfaces of the printed-wiring board 110 so as to be symmetrical with respect to the printed-wiring board 110. In this case, by applying a high-frequency voltage to the antenna element 120, an electric field occurs between the antenna element 120 and the ground element 130 in a direction indicated by an arrow in FIG. 3. Said differently, the electric field is generated in a thickness direction of the printed-wiring board 110.

(Memory Card)

Next, a memory card of the First Embodiment is described. A secure Digital (SD) card is exemplified as the memory card of the First Embodiment. However, the invention is applicable to memory cards in other standards and other types.

Figure 4:
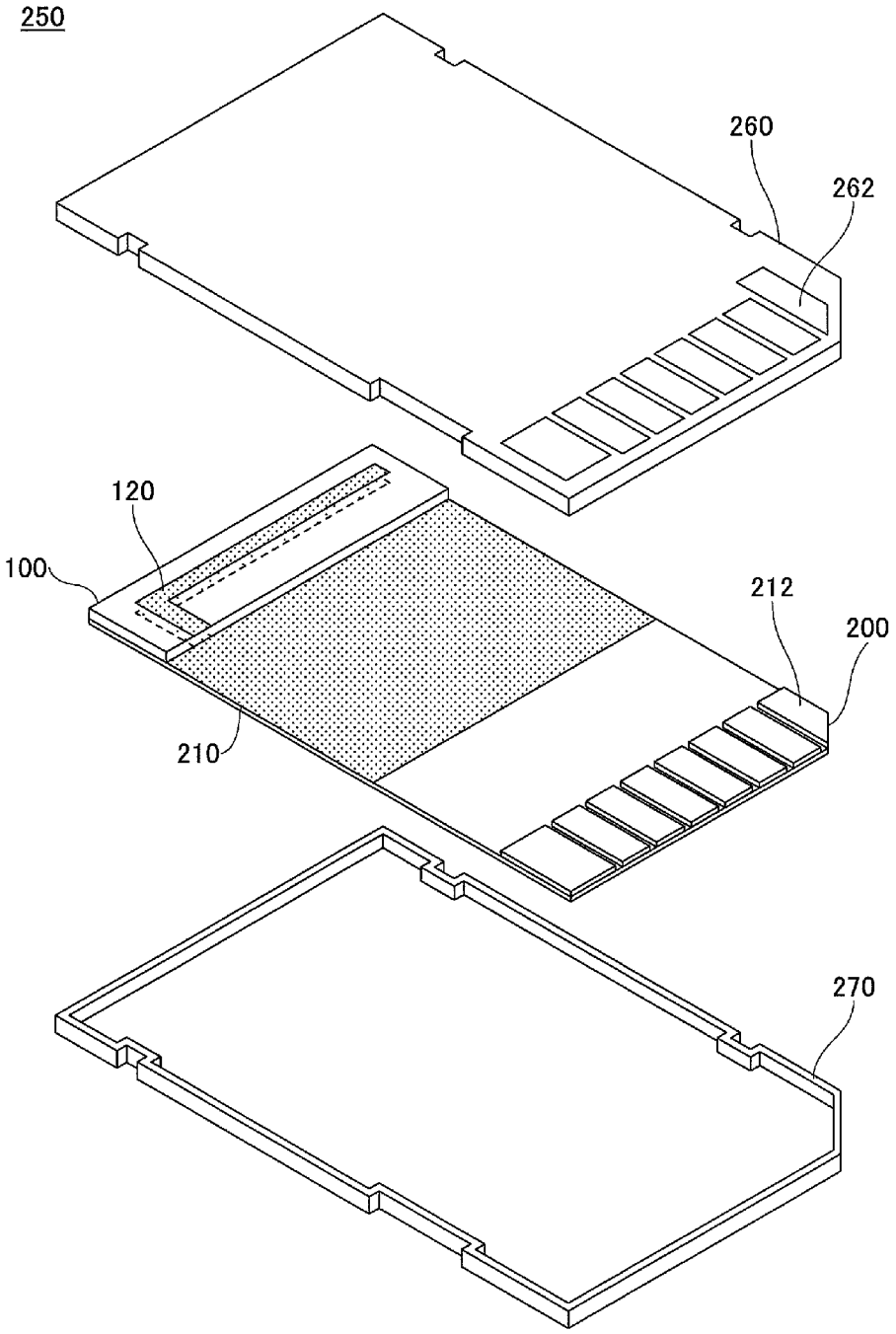
FIG. 4 illustrates a structure of a memory card of the First Embodiment.

Referring to FIG. 4, the memory card 250 of the First Embodiment includes a circuit board 200 in which an antenna device 100 is installed, a first case 260 made of a resin material such as a plastic, and a second case 270. The circuit board 200 is accommodated in a space covered by a first case 260 and a second case 270. The circuit board 200 has an external connection terminal 212 to be connected to a memory card socket inside the digital camera. Further, an electronic circuit or the like is installed in the circuit board 200. An opening portion 262 is formed in the first case 260 so as to expose the external connection terminal 212 to an outside. The memory card 250 is formed by joining the first case 260 to the second case 270 so as to cover the circuit board 200.

The antenna device 100 of the memory card 250 of the First embodiment is provided in an end portion of the circuit board 200 opposite to an end portion where the external connection terminal 212 is provided. Since the external connection terminal 212 is connected to the memory card socket, the external connection terminal can intrude into an inside of a digital camera or the like. Therefore, the antenna device 100 is formed on an outer side of the digital camera or the like in the vicinity of a loading slot of the memory card, whose side is opposite to the side where the external connection terminal 212 is provided.

Figure 5:
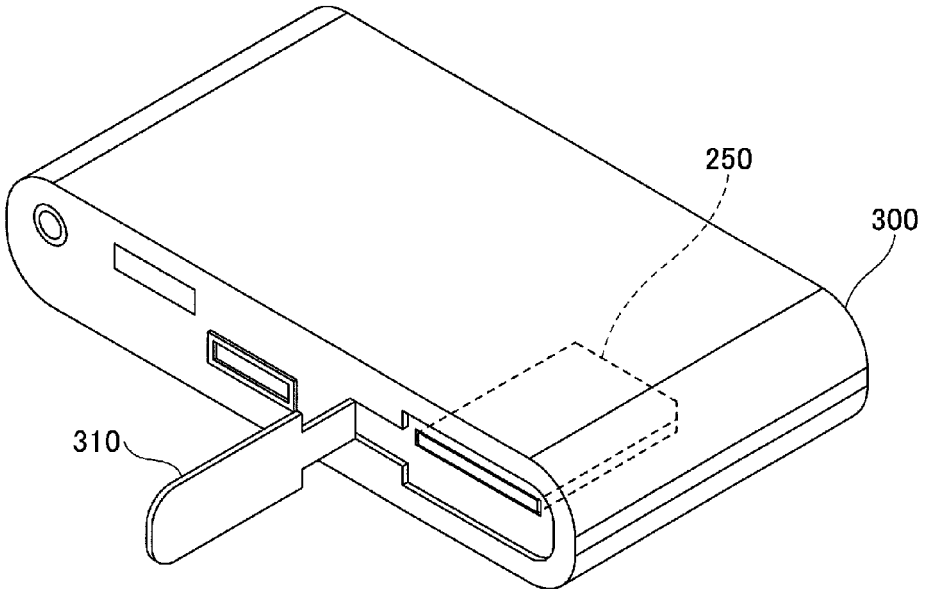
FIG. 5 is a perspective view of a digital camera for illustrating a part of receiving the memory card.
Figure 6:
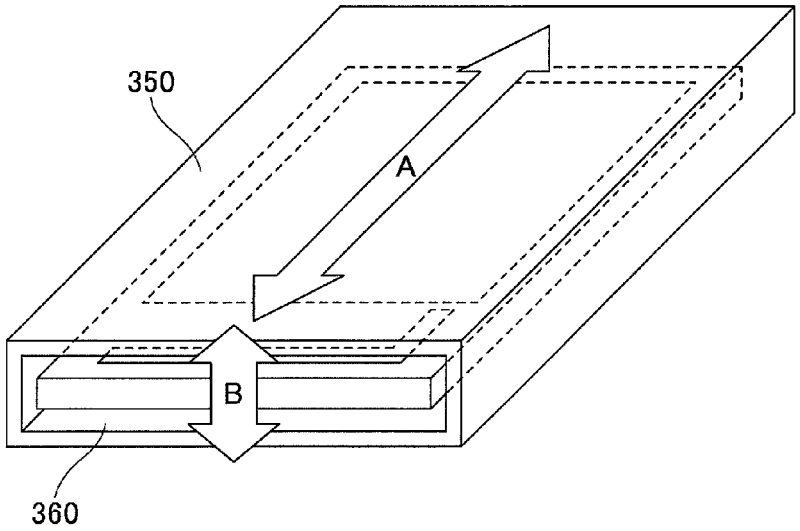
FIG. 6 schematically illustrates excitation in the antenna device of the First Embodiment.

Referring to FIG. 5, when the digital camera 300 is loaded with the memory card 250, the loading slot is covered by a lid 310 provided in the digital camera 300. Therefore, the memory card 250 is enclosed by the casing of the digital camera 300, the memory card socket and the lid 310. Under the condition, the casing of the digital camera 300, the memory card socket and so on may form a so-called wave guide tube. Referring to FIG. 6, when the digital camera is loaded with the memory card 250 including the circuit board 200 having the antenna device 100, it is possible that an antenna exists inside the wave guide tube 350 formed by the casing of the digital camera. Because electromagnetic waves generated by excitation in a direction of an arrow A are shielded by the wave guide tube 350, the electromagnetic waves are only minimally emitted into the outside of the wave guide tube. However, the electromagnetic waves generated by excitation in a direction indicated by an arrow B proceeds inside the wave guide tube 350 and emitted outside the wave guide tube 350 from an opening portion 360 of the wave guide tube 350.

The thickness of a portion such as the lid 310 where the memory card 250 is inserted is thin, and is sometimes made of a material other than a metal. Therefore, it is possible to consider that the opening portion 360 of the wave guide tube 350 is formed in a direction of insertion of the memory card 250. Accordingly, the electromagnetic waves generated by the excitation in the directions indicated by the arrows B from the opening portion 360 are supposed to be emitted outside the wave guide tube 350 of the digital camera 300.

Figure 7:
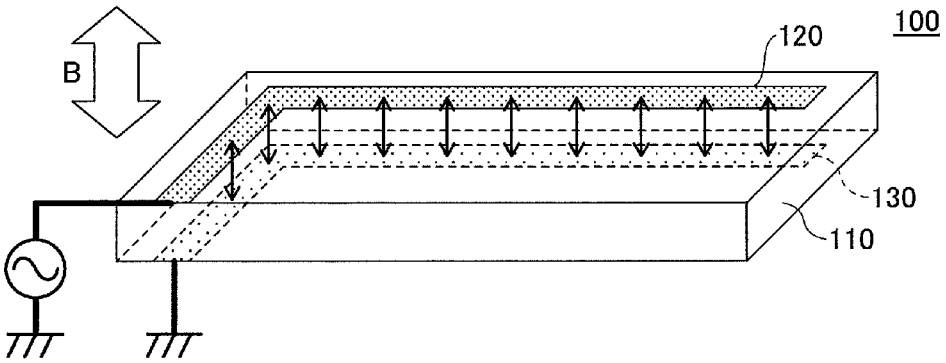
FIG. 7 is a perspective view of the antenna device of the First Embodiment for explaining the excitation.

Referring to FIG. 7, the electric field is applied to the printed-wiring board 110 in the thickness direction (the arrows B) of the printed-wiring board 110 of the memory card 250 of the First Embodiment. Accordingly, the electromagnetic waves generated in the antenna device 100 can be emitted outside the digital camera 300. Because of this, the emitted electromagnetic waves can maintain high intensity.

(Modified Example of Antenna Device)

Figure 8:
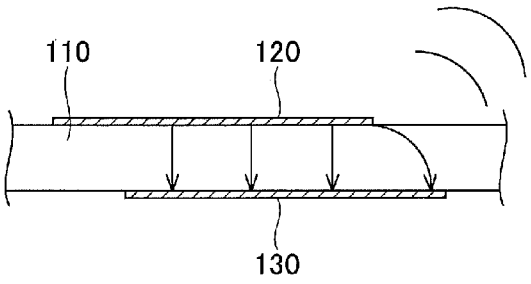
FIG. 8 schematically illustrates a part of another antenna device of the First Embodiment.

Further, referring to FIG. 8, the antenna device of the First Embodiment may be formed so that the position of the antenna element 120 shifts from the position of the ground element 130 with respect to the printed-wiring board 110 (an asymmetrical positional relationship). By shifting the position of the antenna element 120 from the position of the ground element 130, when a high-frequency voltage is applied to the antenna element 120, the electric field generated by the high-frequency voltage leaks from an area where the positions shift. Because the electromagnetic wave generated by the leaking electromagnetic field is generated by excitation in directions different from the thickness directions of the printed-wiring board 110, it may be possible to more effectively emit the electromagnetic wave to the outside of the casing of the digital camera, depending on a type of the digital camera used.

(Manufacturing Method of Antenna Device and Circuit Board)

Next, the manufacturing methods of the antenna device and the circuit board of the First Embodiment are described.

Figure 9:
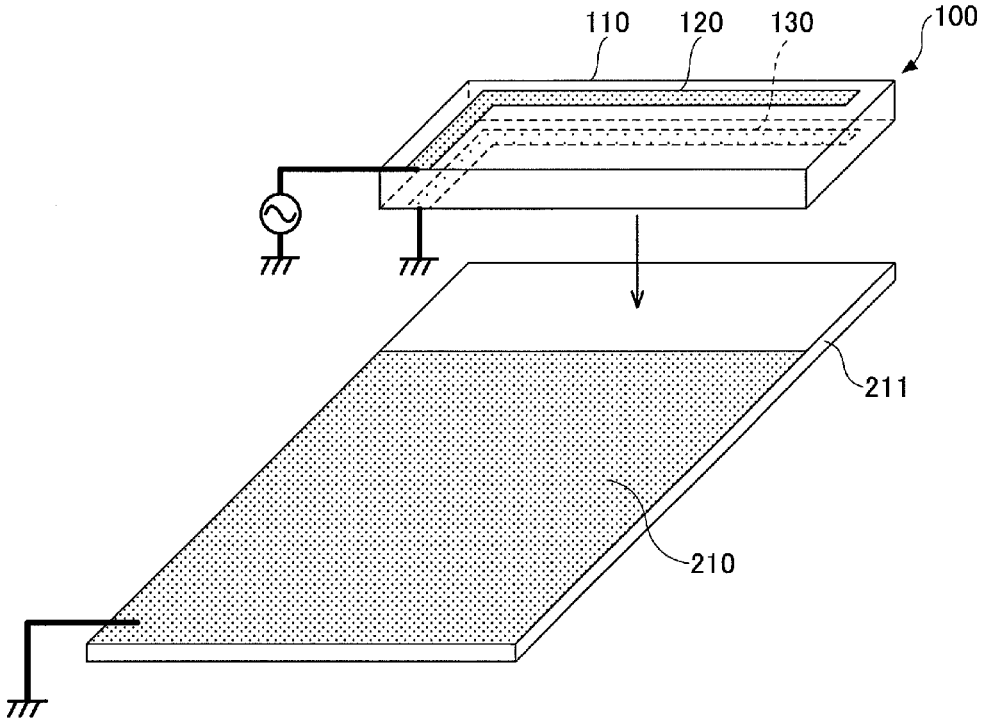
FIG. 9 illustrates a first structure of the circuit board of the First Embodiment.

Referring to FIG. 9, the circuit board 200 of the First Embodiment may be formed by bonding the antenna device 100, which includes the printed-wiring board 110 on both surfaces of which the antenna element 120 and the ground element 130 are formed, to a predetermined position of the printed-wiring board 211 on which a ground area 210 is formed. Further, the ground element 130 is connected to the ground area 210.

Figure 10:
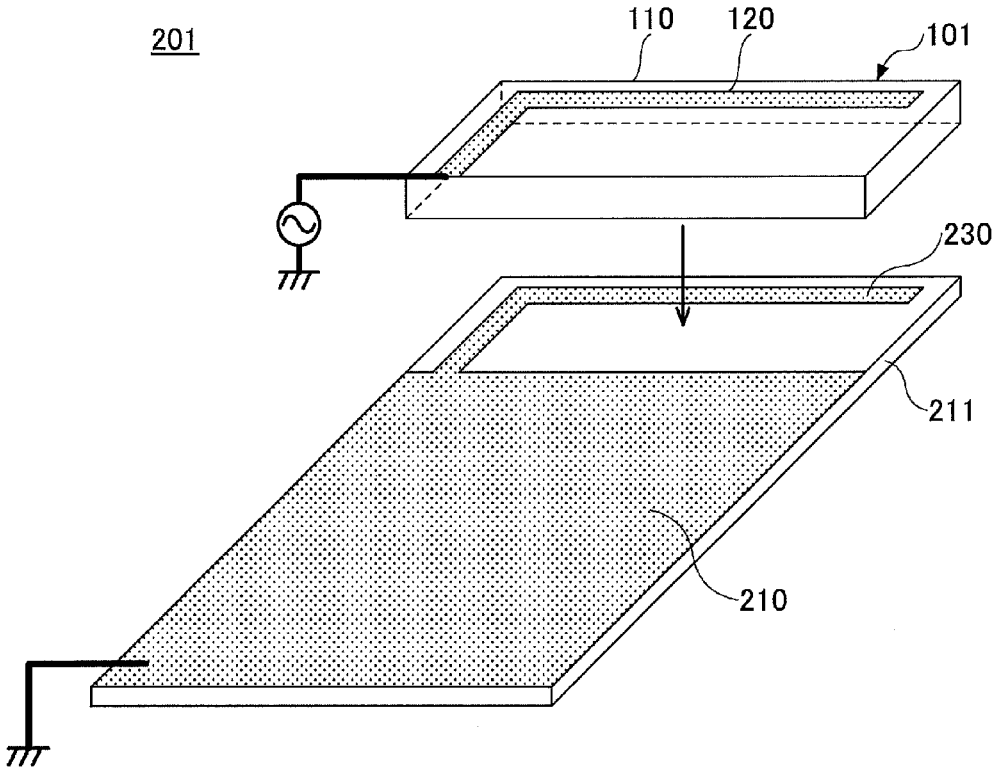
FIG. 10 illustrates a second structure of the circuit board of the First Embodiment.

Further, referring to FIG. 10, the circuit board 201 of the First Embodiment may be formed by bonding a printed-wiring board 110 having the antenna element 120 on one surface of the printed-wiring board to a printed-wiring board 211 having a ground area 210, and a ground element 230 connected to the ground area 210 so that the other surface of the printed-wiring board 110 faces the ground element 230 of the printed-wiring board 211.

Figure 11:
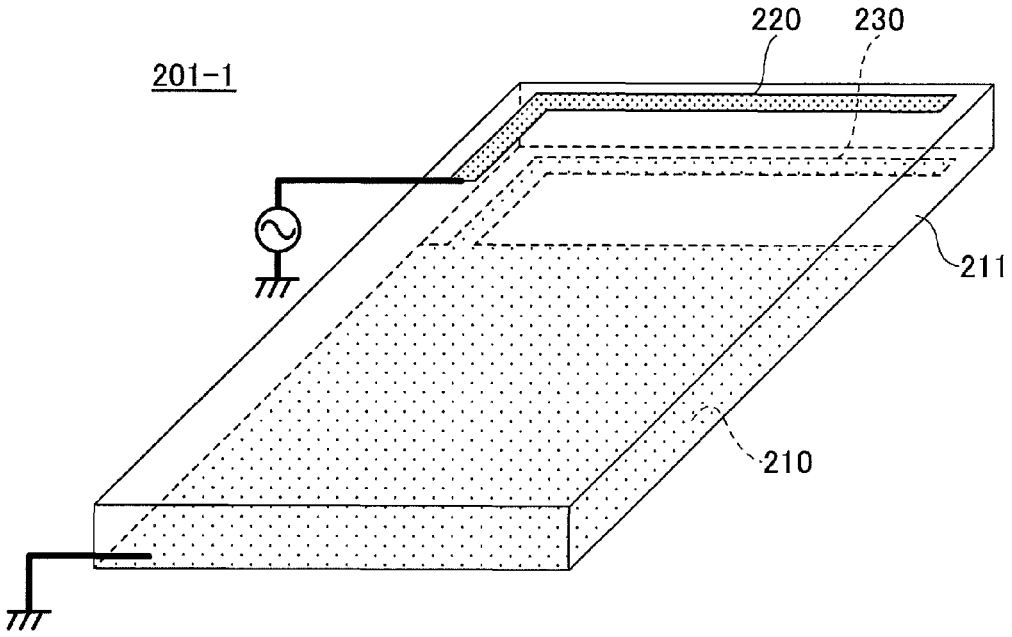
FIG. 11 illustrates a third structure of the circuit board of the First Embodiment.
Figure 12:
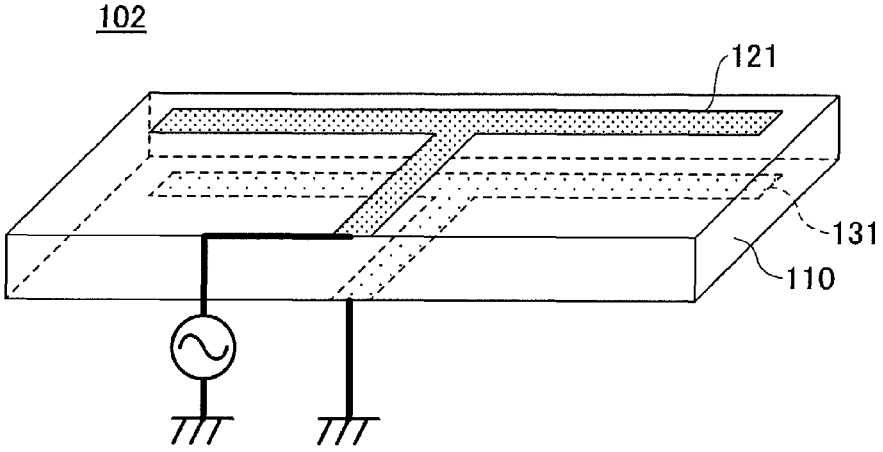
FIG. 12 schematically illustrates a part of another antenna device of the First Embodiment.

Referring to FIG. 11, the circuit board 201-1 of the First Embodiment may be structured to have an antenna element 220 on one surface of the printed wiring board 211, and a ground element 230 and a ground area 210 connected to the ground element on the other surface of the printed wiring board 211. With this structure, the number of the printed-wiring board is one to thereby enable obtaining the circuit board having the antenna device at a lower cost.

Functionally, the antenna element 220 corresponds to the antenna element 120, and the ground element 230 corresponds to the ground element 130.

The shape of the antenna device 102 is not limited to the inverse L shape and may be a T shape. Specifically, referring to FIG. 12, an antenna element 121 in a T-like shape is formed on one surface of the printed-wiring board 110 and a ground element 131 in a T-like shape may be formed on the other surface of the printed wiring board 110.

In the First Embodiment, an electronic circuit or the like may be formed on the printed-wiring board 211. However, the electronic circuit or the like is omitted in the figures. Specifically, there may be cases where the electronic circuit or the like is formed in an area where there is no ground area or where the printed-wiring board 211 has a multilayer structure and an electronic circuit or the like is formed inside the multilayer structure.

(Propagation Characteristics)

Figure 14:
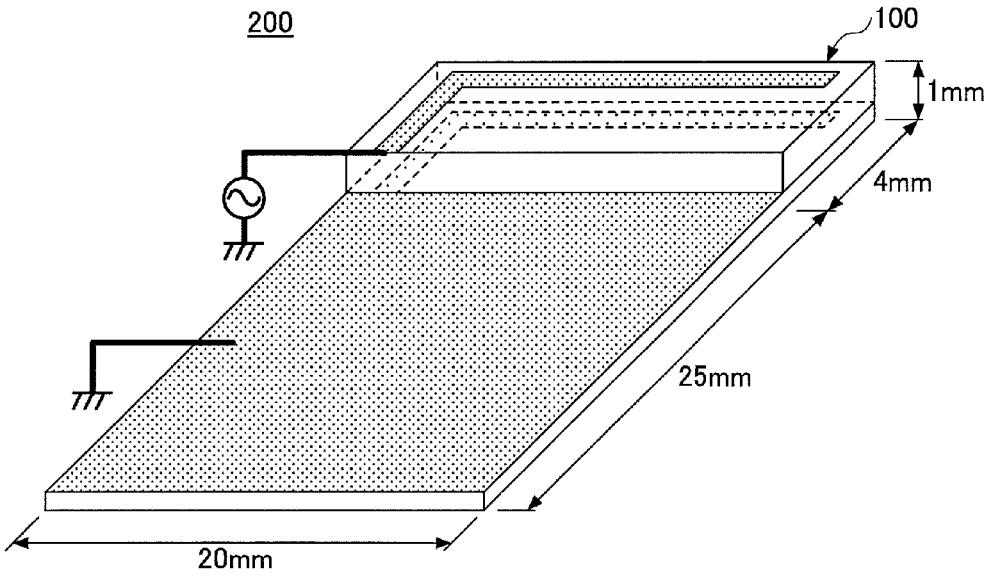
FIG. 14 illustrates the structure of the circuit board used in measuring propagation in the First Embodiment.

Next, propagation characteristics of electromagnetic waves in the antenna device, the circuit board and the memory card of the First Embodiment are described. Specifically, the digital camera 300 loaded with the memory card 250 including the circuit board 200 of the First Embodiment as illustrated in FIG. 14 is measured to obtain the propagation characteristics of electromagnetic waves. Referring to the circuit board 200 illustrated in FIG. 14, the thickness and the width of the printed-wiring board 110 forming the antenna device 100 are 1 mm and 4 mm, respectively, and the size of the circuit board 200 is 20 mm×29 mm.

Figure 13:
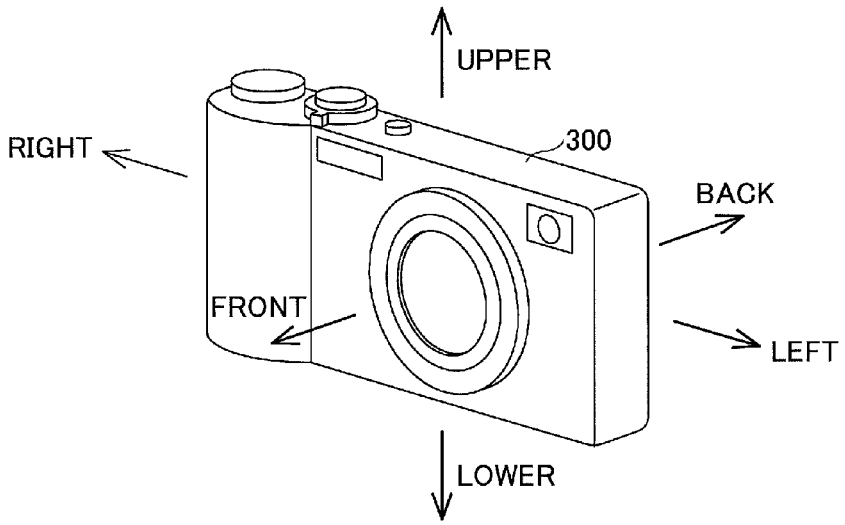
FIG. 13 is a perspective view of the digital camera in which the memory card is installed.
Figures 15, 16:
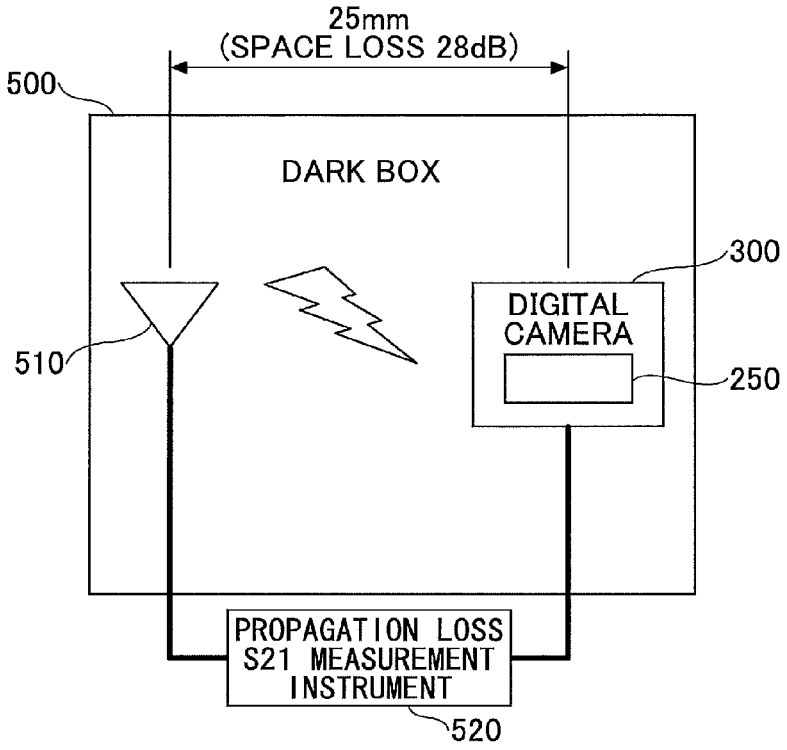
FIG. 15 illustrates a method of measuring the propagation.
FIG. 16 illustrates a result of the measured propagation.

The measurement method of the propagation characteristics is such that a digital camera 300 and a standard antenna 510 are provided in a dark box 500 as illustrated in FIG. 15. From an antenna device 100 of the memory card 250 in the digital camera 300, a high frequency signal of 2.45 GHz is generated and sent to a standard antenna 510 located apart by 25 cm from the digital camera 300. The standard antenna 510 receives the high frequency signal of 2.45 GHz. The received electromagnetic waves are measured by a propagation loss S21 measurement instrument 520 installed outside the dark box 500. Referring to FIG. 13, the standard antenna 510 is arranged on a front side (on a side of a lens mounted in the digital camera), a back side, a right side, a left side, an up side and a down side. The distance between the digital camera 300 and the standard antennas 510 was 25 cm and a space loss was 28 dB.

FIG. 16 illustrates propagation characteristics measured in a case where the memory cards 250 of the First Embodiment are used for two digital cameras, respectively, and in a case where conventional memory cards having antennas are used for these digital cameras, respectively. The propagation loss S21 of the digital camera A loaded with the conventional memory card with the antenna was −52.7 dB to −43.7 dB. Meanwhile, the propagation loss S21 of the digital camera A loaded with the memory card with the antenna of the First Embodiment was −53.2 dB to −42.1 dB. Thus, the propagation loss S21 can be reduced in the memory card with the antenna of the First Embodiment. The propagation loss S21 of the digital camera B loaded with the conventional memory card with the antenna was −54.3 dB to −48.0 dB. Meanwhile, the propagation loss S21 of the digital camera B loaded with the memory card with the antenna of the First Embodiment was −52.7 dB to −40.2 dB. Thus, again, the propagation loss S21 can be reduced in the memory card with the antenna of the First Embodiment.

Figure 17:
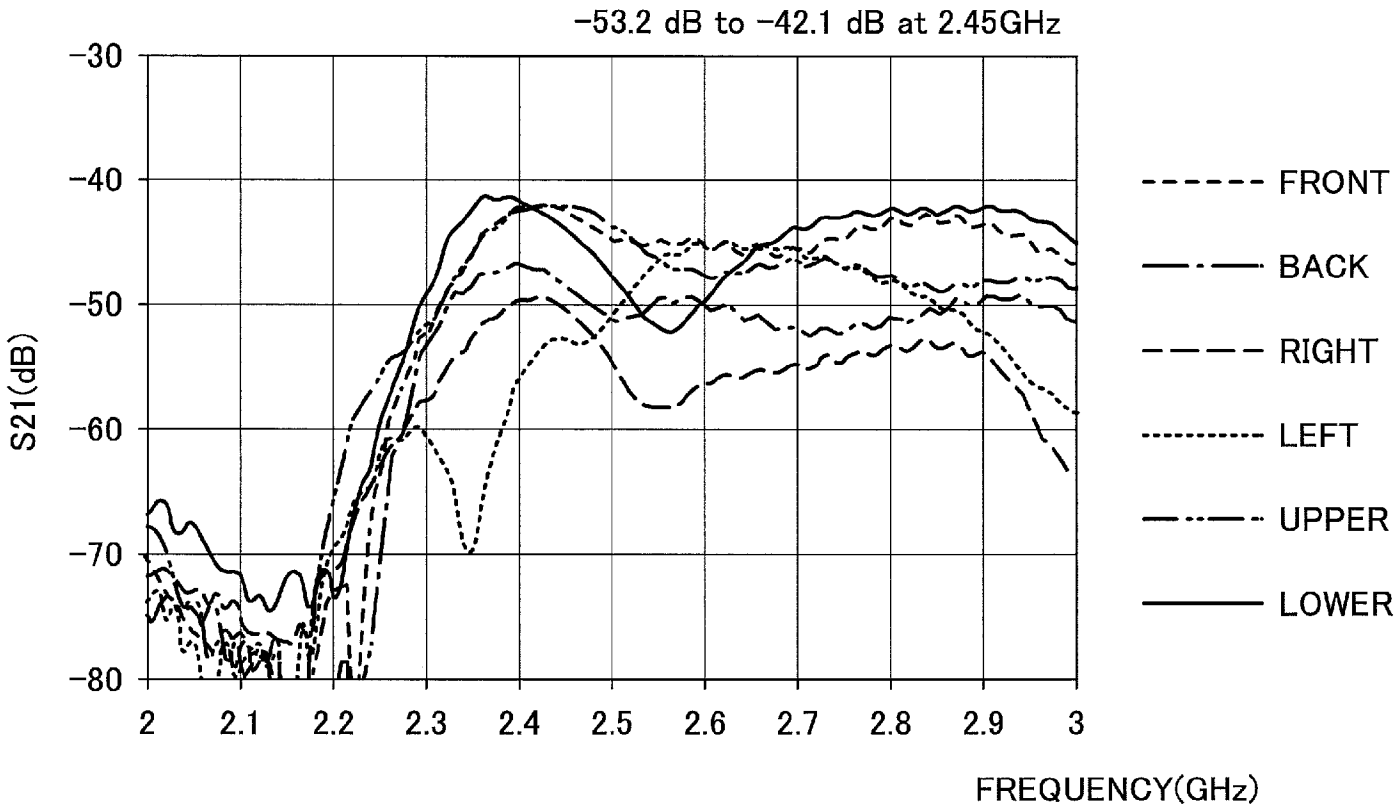
FIG. 17 is a first characteristic diagram of a propagation loss S21 of the digital camera in which the memory card of Embodiment 1 is installed.

FIG. 17 illustrates a relationship between the frequency and the propagation loss S21 on the front side, the back side, the right side, the left side, the upper side, and the lower side in the digital camera A. In a case where the digital camera A is loaded with the memory card 250 of the First Embodiment, the propagation losses in the frequency of 2.4 to 2.5 GHz on the down side, the upper side and the front side are relatively low and the propagation losses in the frequency of 2.4 to 2.5 GHz on the back side, the right side and the left side are relatively high.

Figure 18:
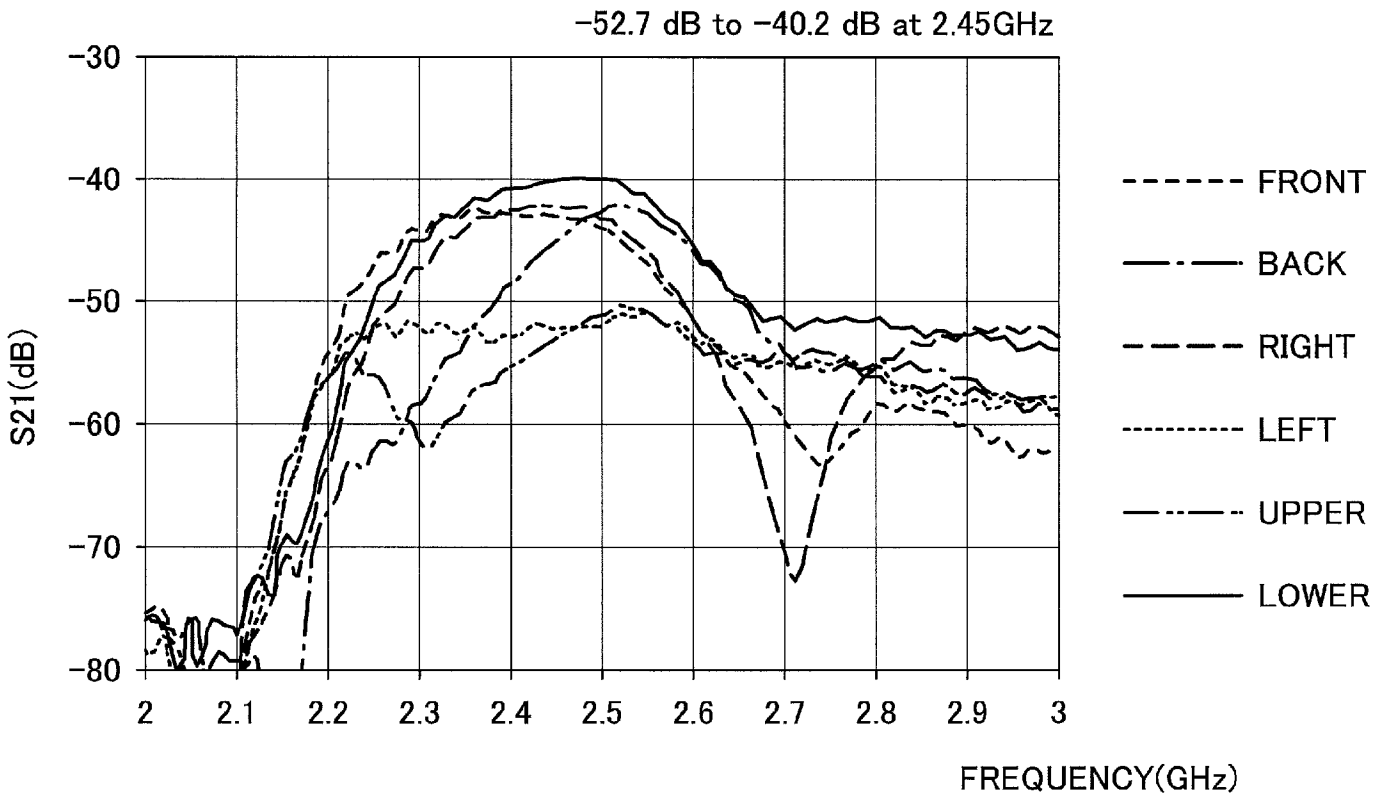
FIG. 18 is a second characteristic diagram of a propagation loss S21 of the digital camera in which the memory card of Embodiment 1 is installed.

FIG. 18 illustrates a relationship between the frequency and the propagation loss S21 on the front side, the back side, the right side, the left side, the upper side and the lower side in the digital camera B. In a case where the digital camera B is loaded with the memory card 250 of the First Embodiment, the propagation losses in the frequency of 2.4 to 2.5 GHz on the down side, the right side and the front side are relatively low, the propagation loss in the frequency of 2.4 to 2.5 GHz on the back side is neutral, and the propagation losses in the frequency of 2.4 to 2.5 GHz on the left side and the upper side are relatively high.

As described, by using the memory card of the First Embodiment, the propagation loss can be reduced with respect to the type of digital camera and the sides where the antenna is mounted. With this, the electromagnetic waves can be emitted outside the digital camera with a small propagation loss.

Meanwhile, because the memory card of the First Embodiment is shaped to be substantially the same as a memory card such as an SD card, it is referred to as the memory card. However, this memory card could potentially not include a memory as a recording medium.

Second Embodiment

Figure 19:
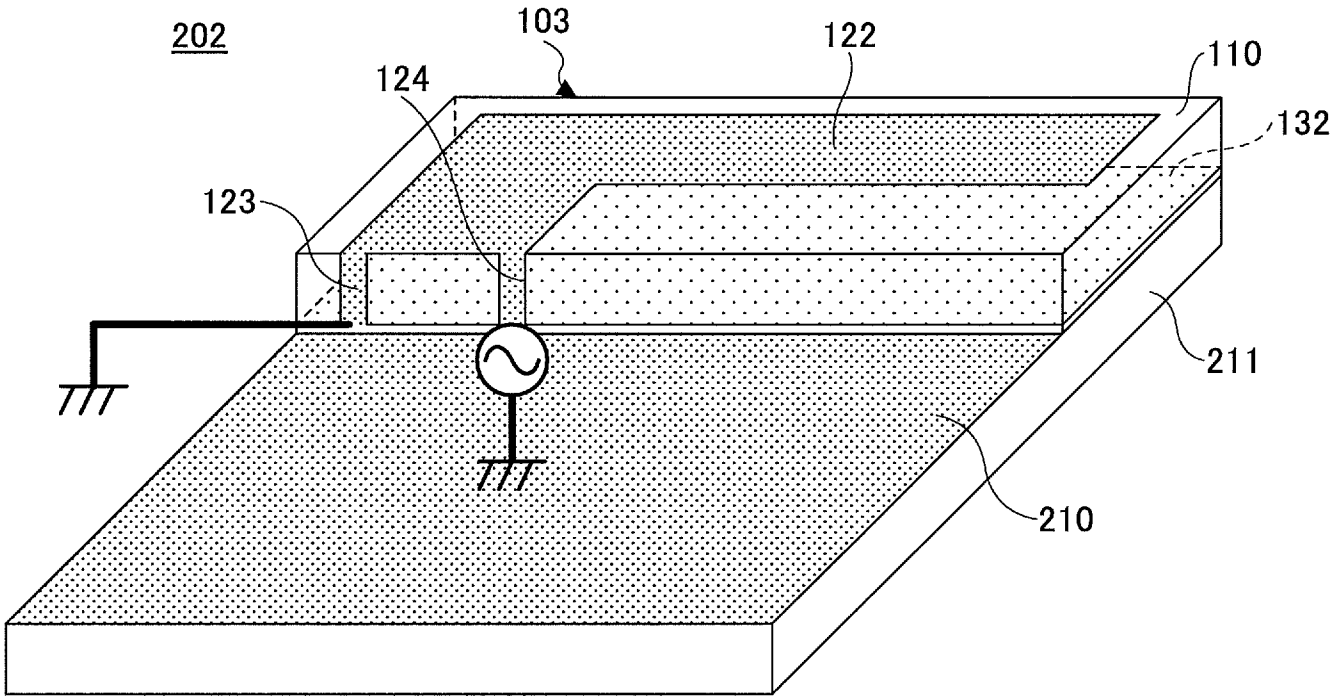
FIG. 19 illustrates the structure of a circuit board of a Second Embodiment.

The Second Embodiment is described next. In the Second Embodiment, the circuit board and the memory card in which the antenna device is installed are described. Referring to FIG. 19, an antenna device 103 of a circuit board 202 of the Second Embodiment includes an antenna element 122 formed on one surface of a printed-wiring board 110 and a ground element 132 formed in the other surface of the printed-wiring board 110 in its entirety. The antenna element 122 includes a first side antenna element 123 on a side surface of the printed-wiring board 110 and a second side surface antenna element 124 on the side surface of the printed-wiring board 110 to thereby form an inverse F shape (hereinafter, the antenna formed in the inverse F shape may be referred to as the antenna of the inverse F type). The first side antenna element 123 is connected to the ground element 132 formed on the printed-wiring board 110 so as to be applied with a high-frequency voltage greater than that to the antenna element 124. The ground element 132 on the surface of the printed-wiring board 211 is connected to the ground area 210 formed on the surface of the printed-wiring board 210.

Figure 20:
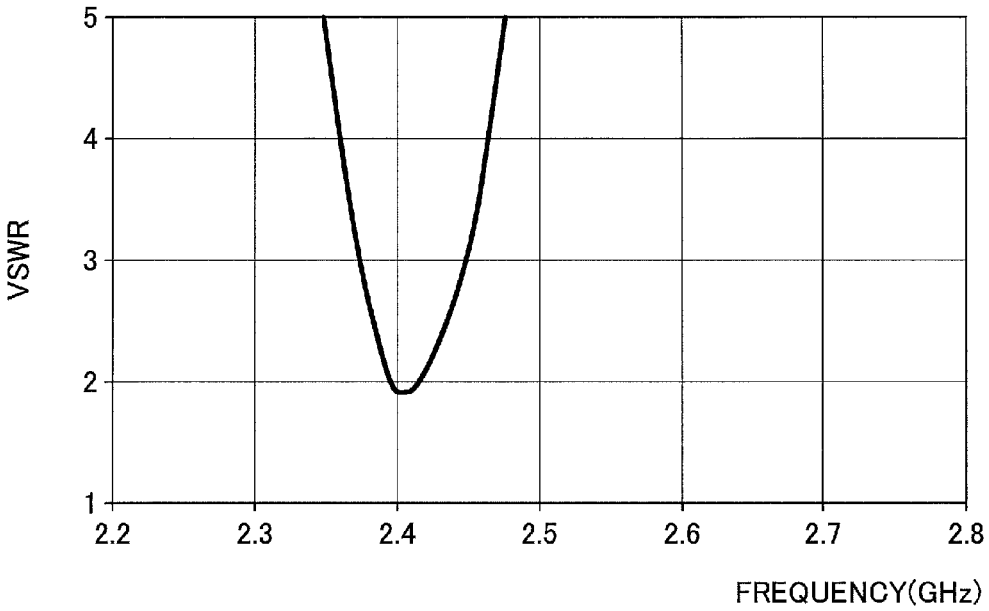
FIG. 20 is a VSWR characteristic diagram of the circuit board of the Second Embodiment.

Voltage Standing Wave Ratio (VSWR) characteristics of the circuit board 202 of the Second Embodiment are illustrated in FIG. 20. The lower the value of the VSWR, the smaller the reflection. In the circuit board 202, the value of VSWR is 2 or smaller in the vicinity of the frequency of 2.4 GHz. Therefore, the VSWR characteristics were good.

Figure 21:
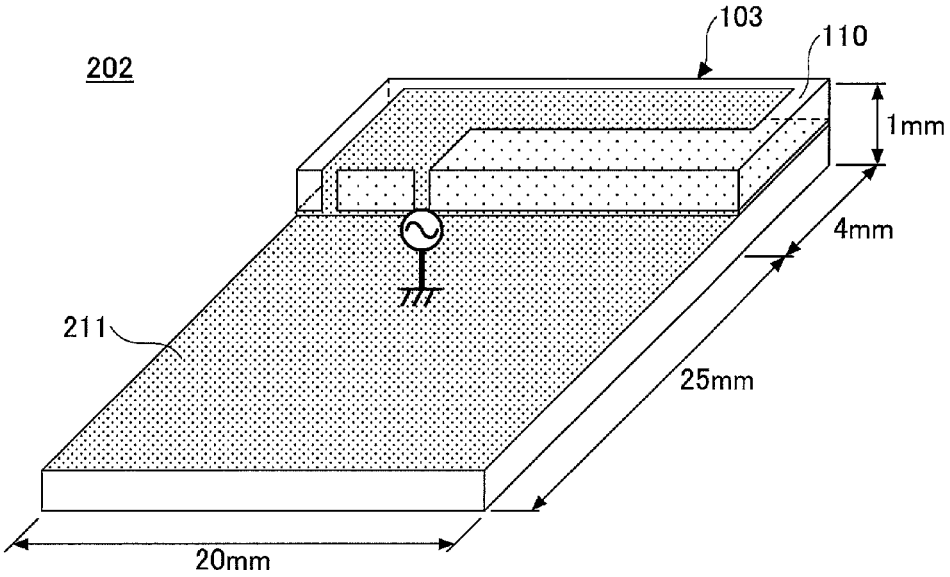
FIG. 21 illustrates a structure of a circuit board used in measuring propagation in the Second Embodiment.

The memory card is prepared in a similar manner to the First Embodiment, but this time using the circuit board 202 of the Second Embodiment. A digital camera illustrated in FIG. 13 is loaded with the memory card of the Second Embodiment. A propagation loss S21 of the digital camera is measured in a similar manner to the method of the First Embodiment. In the Second Embodiment, the digital camera is the digital camera A of the First Embodiment. The circuit board 202 is formed as illustrated in FIG. 21. The thickness of the printed-wiring board 110 is 1 mm, the width thereof is 4 mm, the size thereof is 20 mm×29 mm.

Figure 22:
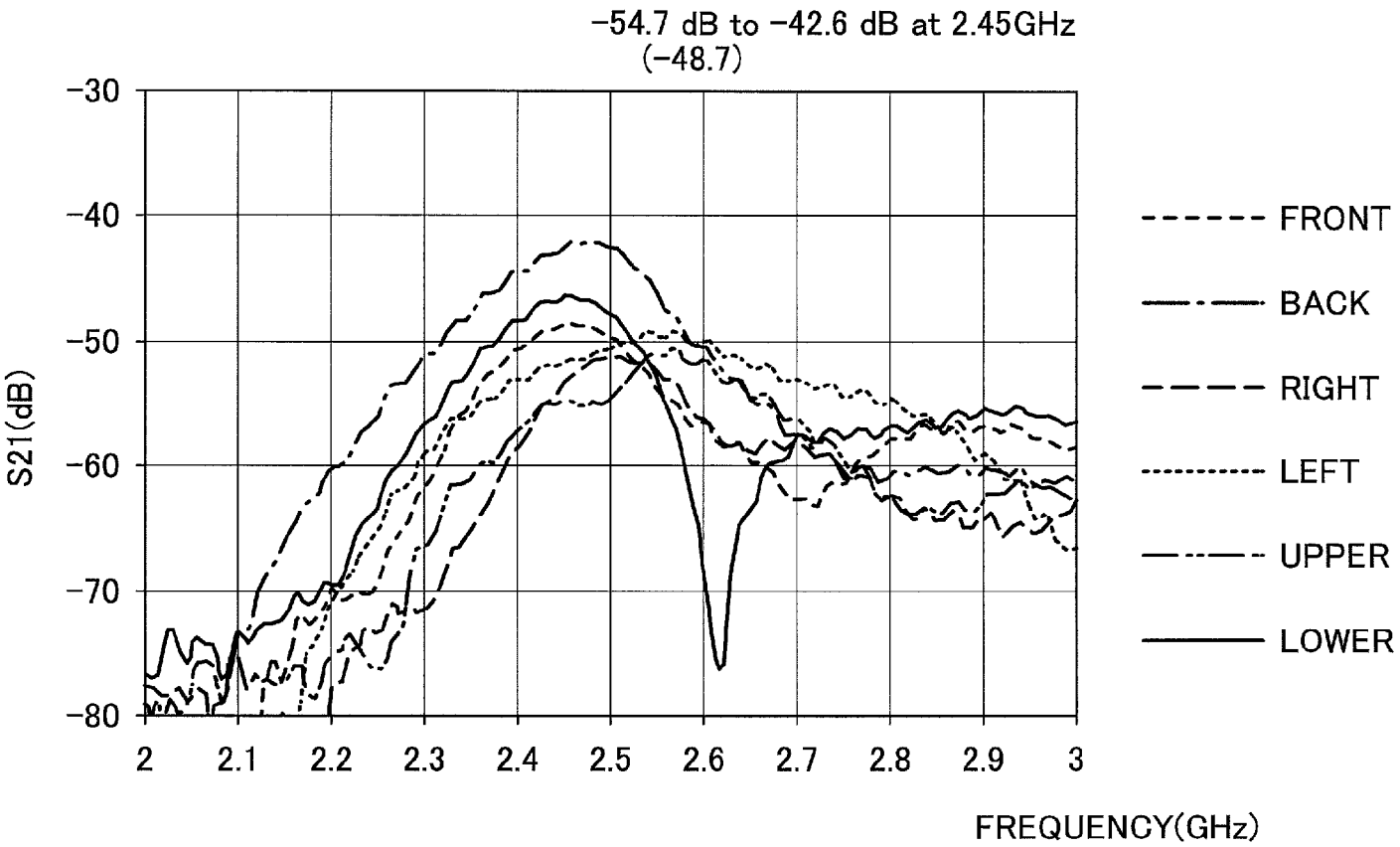
FIG. 22 is a characteristic diagram of a propagation loss S21 of a digital camera in which a memory card of the Second Embodiment is installed.
Figure 23:
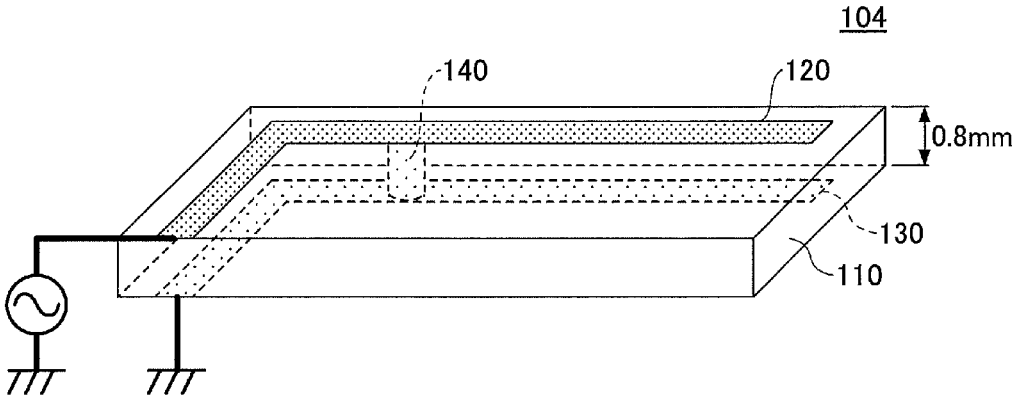
FIG. 23 illustrates a structure of an antenna device of a Third Embodiment.

FIG. 22 illustrates a relationship between the frequency and the propagation loss S21 on the front side, the back side, the right side, the left side, the upper side and the lower side. When the digital camera A is loaded with the memory card of the Second Embodiment, the propagation loss in the frequency of 2.4 to 2.5 GHz is the smallest on the back side and the propagation loss on the bottom side, that on the front side, that on the left side, that on the right side and that on the upper side increase in this order. The propagation loss in the frequency of 2.45 GHz was −54.7 to −42.6 dB. The other portions are the same as those in the First Embodiment.

Third Embodiment

Figure 24:
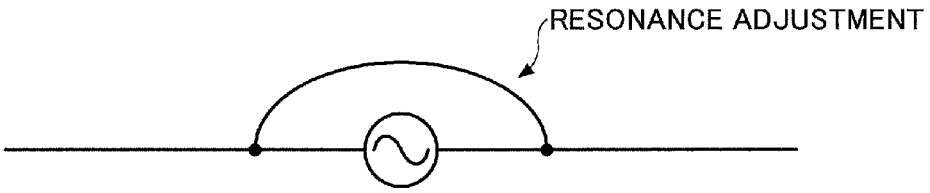
FIG. 24 is an equivalent circuit schematic of an antenna device of the Third Embodiment.

The Third Embodiment is described next. An antenna device 104 of the Third Embodiment is a dipole antenna in which an antenna element and a ground element are connected. Specifically, referring to FIG. 23, a connecting portion 140 made of a metal such as copper is formed inside a through hole provided in a printed-wiring board 110 to connect the antenna element 20 to the ground element 130. Thus, the dipole element is formed. As described, by connecting the antenna element 120 to the ground element 130 by the connecting portion 140, the equivalent circuit becomes as illustrated in FIG. 24 enabling adjusting resonance.

A position where the connecting portion 140 (the throughhole) is determined by a resonance frequency or the like. For example, referring to FIG. 25, the throughhole may be formed on end portions of the antenna element 120 and the ground element 130 and the connecting portion 140 is formed in the throughhole to thereby connect the antenna element 120 to the ground element 130.

Figure 25:
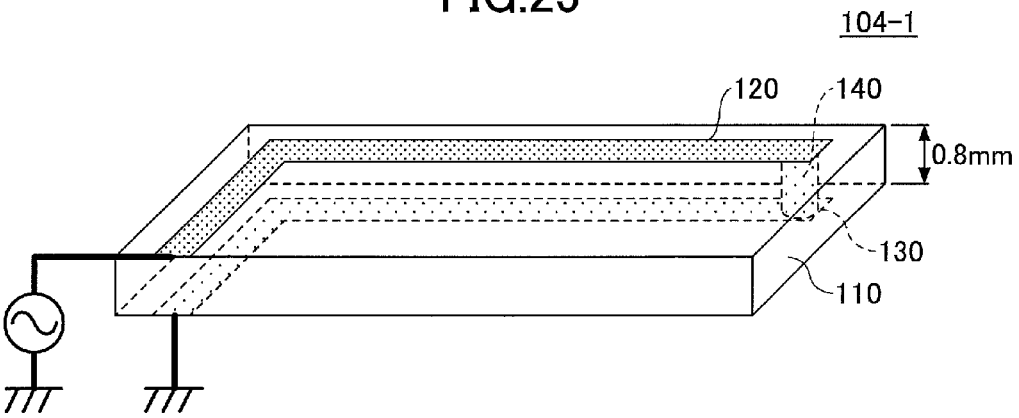
FIG. 25 schematically illustrates a part of another antenna device of the Third Embodiment.
Figure 26:
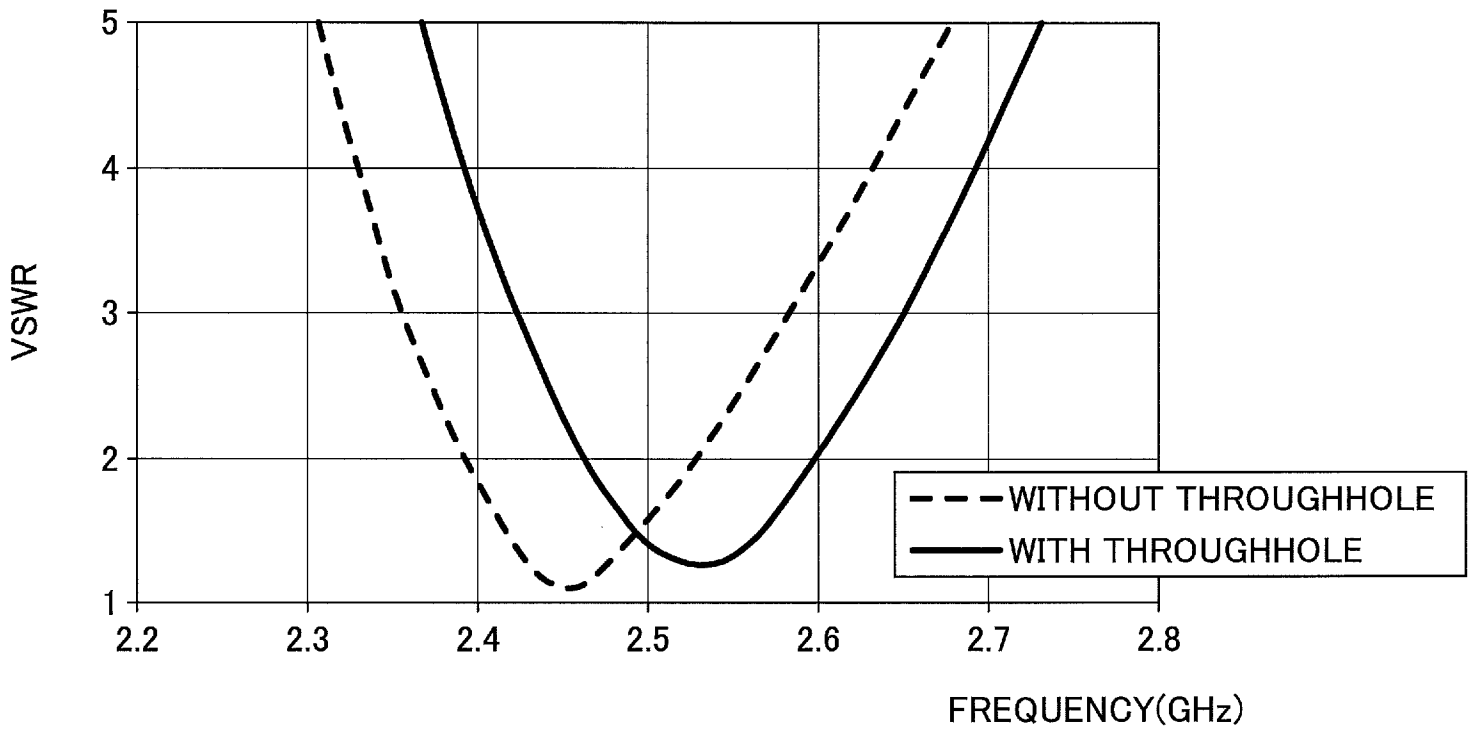
FIG. 26 is a VSWR characteristic diagram of the circuit board of the Second Embodiment.

VSWR characteristics of a circuit board including the antenna device 104-1 illustrated in FIG. 25 (with the through hole) prepared in a similar manner to the First Embodiment and a circuit board of the First Embodiment (without the through hole) are illustrated in FIG. 26. Referring to FIG. 26, by forming the throughhole to connect the antenna element 120 to the ground element 130 at a predetermined position by the connecting portion 140 in the throughhole, it is possible to shift the frequency range to a desired frequency band. With this, the frequency range can be easily and minutely adjusted. The other portions are the same as those in the First Embodiment.

Fourth Embodiment

Figure 27:
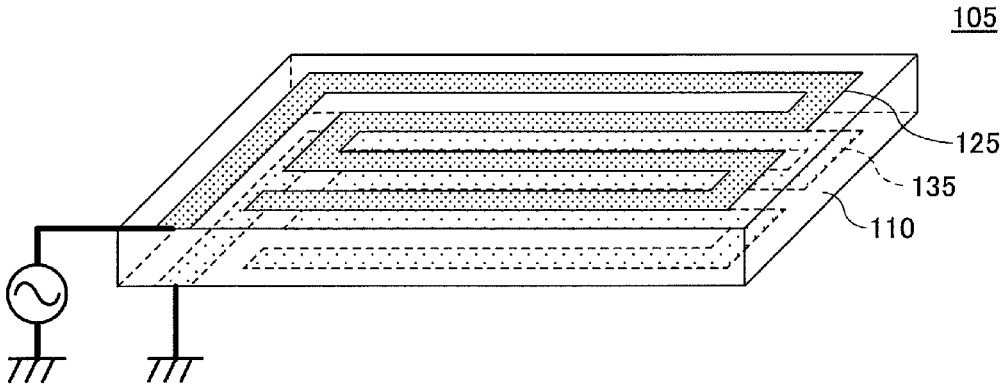
FIG. 27 illustrates a structure of an antenna device of a Fourth Embodiment.

The Fourth Embodiment is described next. An antenna device 105 is formed so that an antenna element 125 and a ground element 135 have a meander shape as illustrated in FIG. 27. In the Fourth Embodiment, the shape is referred to as a meander pattern.

The antenna element 125 and the ground element 135 to be formed have substantially the same shape. By forming the antenna element 125 and the ground element 135 to be in a meander pattern, it is possible to form the antenna device so that the area on which the antenna is formed is not expanded much, and has a predetermined inductance.

(Manufacturing Method of Antenna Device and Circuit Board)

Next, the manufacturing methods of the antenna device and a circuit board 205 of the Fourth Embodiment are described.

Figure 28:
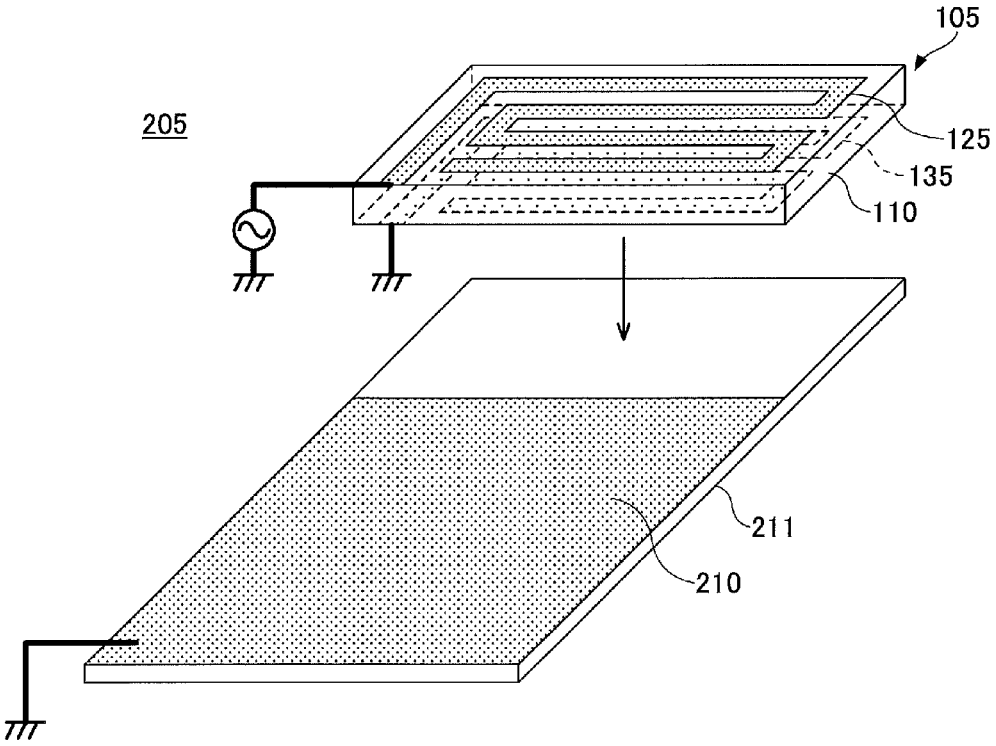
FIG. 28 illustrates a first structure of the circuit board of the Fourth Embodiment.

Referring to FIG. 28, a circuit board 205 of the Fourth Embodiment may be formed by bonding the antenna device 105, which includes the printed-wiring board 110 on both surfaces of which the antenna element 125 of the meander pattern and the ground element 135 of the meander pattern are formed, to a predetermined position of the printed-wiring board 211, on which a ground area 210 is formed. Further, the ground element 135 is connected to the ground area 210.

Figure 29:
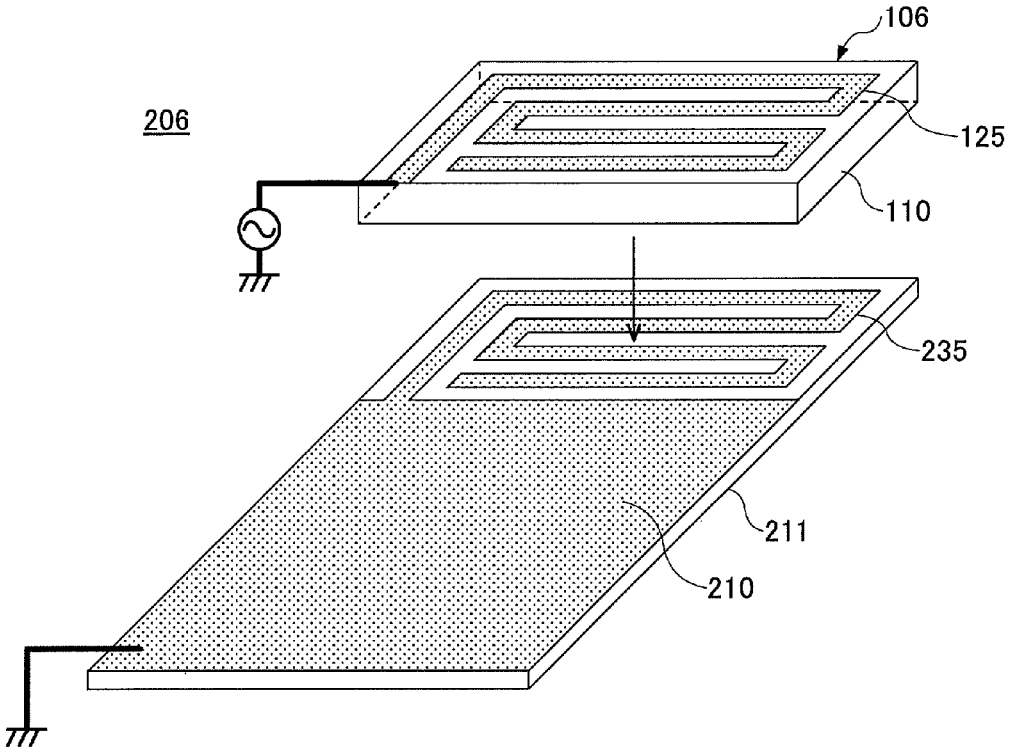
FIG. 29 illustrates a second structure of the circuit board of the Fourth Embodiment.

Further, referring to FIG. 29, the circuit board 206 of the Fourth Embodiment may be formed by bonding a printed-wiring board 110 having the antenna element 125 on one surface of the printed-wiring board 110 to a printed-wiring board 211 having a ground area 210 and a ground element 235 of the meander pattern connected to the ground area 210, so that the other surface of the printed-wiring board 110 faces the ground element 235 of the printed-wiring board 211.

Figure 30:
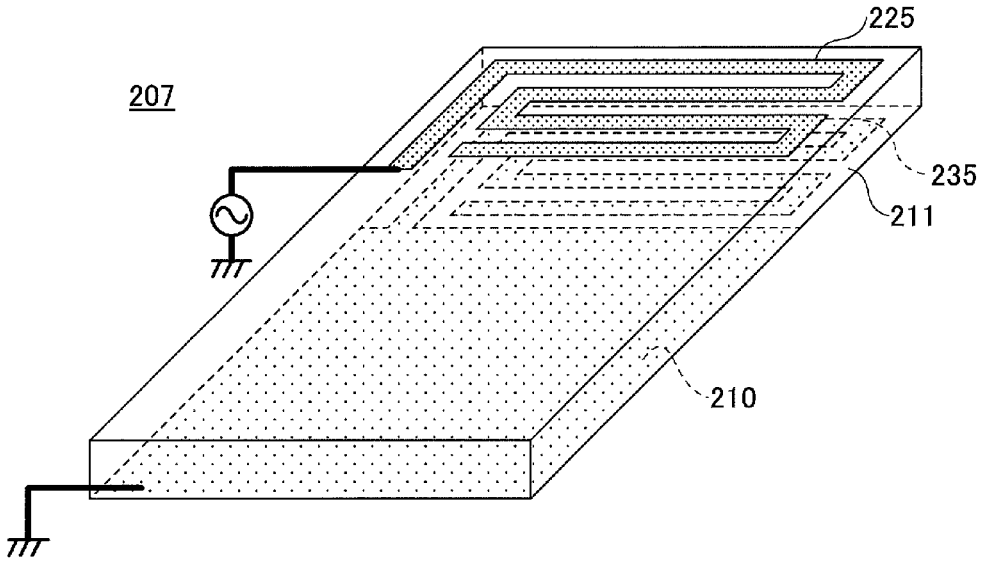
FIG. 30 illustrates a third structure of the circuit board of the Fourth Embodiment.

Referring to FIG. 30, the circuit board 207 of the Fourth Embodiment may be configured to have an antenna element 225 of the meander pattern on one surface of the printed wiring board 211, and a ground element 235 of the meander pattern and a ground area 210 connected to the ground element 235 on the other surface of the printed wiring board 211. With this structure, the number of the printed-wiring board is only one, thereby obtaining a circuit board having the antenna device at a lower cost.

Functionally, the antenna element 225 corresponds to the antenna element 125, and the ground element 235 corresponds to the ground element 135.

Figure 31:
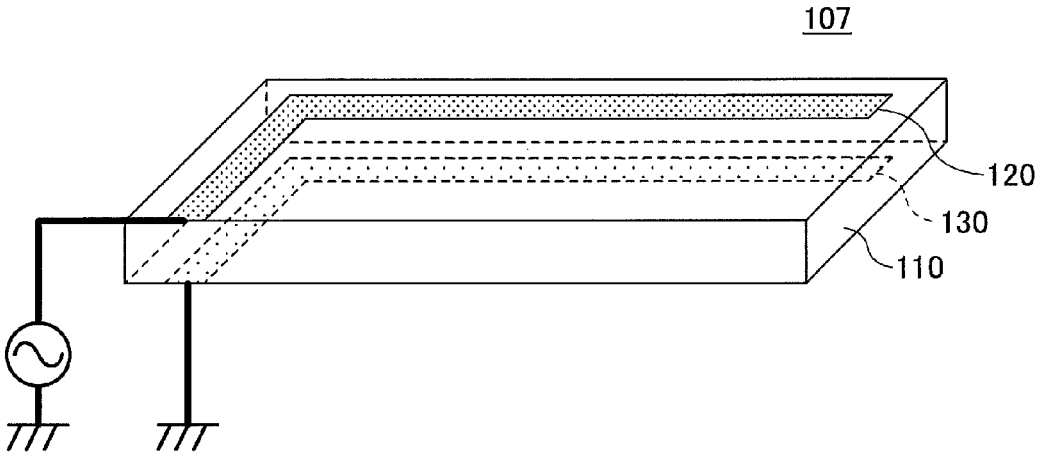
FIG. 31 illustrates a structure of an antenna device having no meander pattern.
Figure 32:
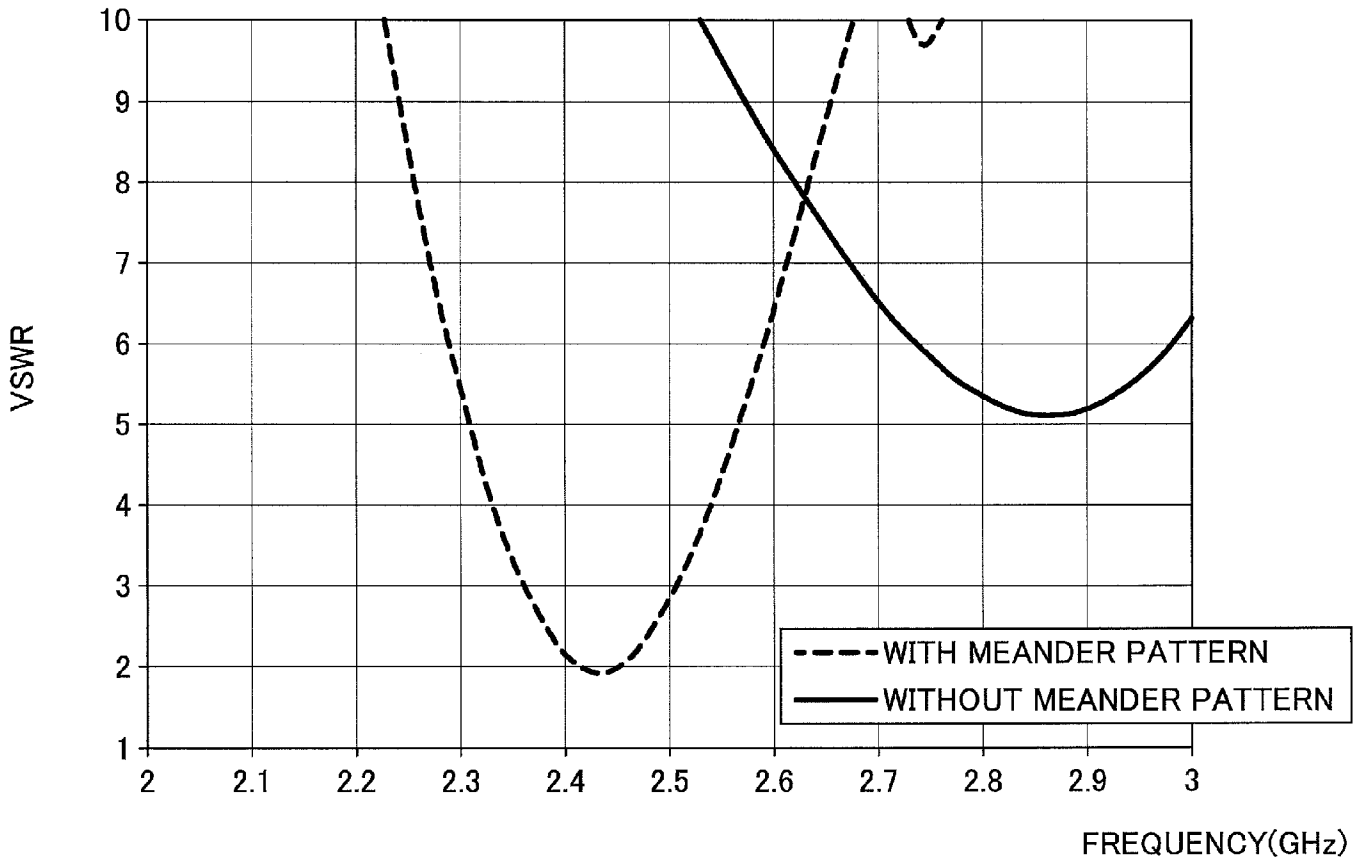
FIG. 32 is a VSWR characteristic diagram of the circuit board of the Fourth Embodiment.

VSWR characteristics of the circuit board 207 in which the antenna device having the meander pattern as illustrated in FIG. 27 is formed and the circuit board in which the antenna device 107 without the meander pattern as illustrated in FIG. 31 are illustrated in FIG. 32. Referring to FIG. 32, by forming the antenna element 125 of the meander pattern and the ground element 135 of the meander pattern, the value of VSWR can be further reduced. The antenna device 107 without the meander pattern is structured in a similar manner to the antenna device of the First Embodiment. However, in order to compare with the antenna device with the meander pattern illustrated in FIG. 27, the antenna device 107 is adjusted by conditions different from those of the First Embodiment. The other portions are the same as those in the First Embodiment.

Fifth Embodiment

The Fifth Embodiment is described next. An antenna device 108 of the Fifth Embodiment is configured to lower the resonance frequency by narrowing an interval between an antenna element 120 and a ground element 130 to increase an electrostatic capacitance. By lowering the resonance frequency, the antenna device 108 is adjusted for a predetermined frequency range.

Figure 33:
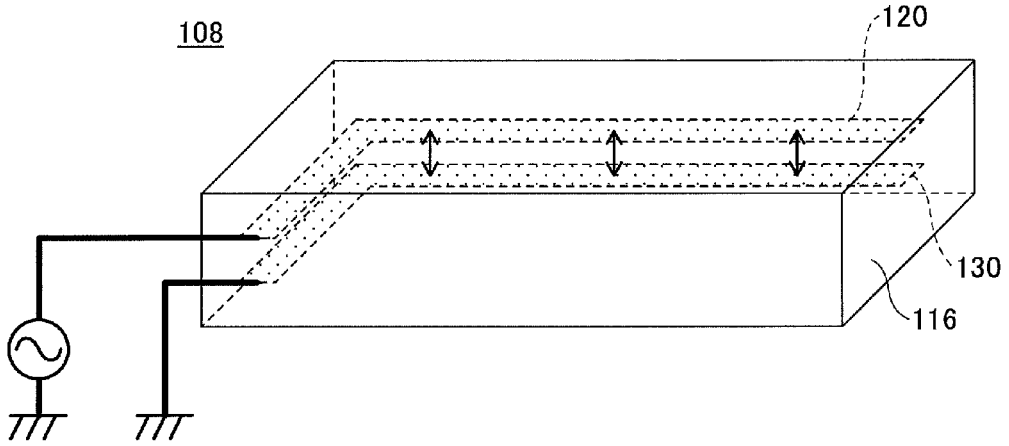
FIG. 33 illustrates a structure of an antenna device of a Fifth Embodiment.

Ordinarily, the printed-wiring board has a predetermined thickness to maintain predetermined strength. Therefore, there is a limit in increasing the electrostatic capacitance. Referring to FIG. 33, the antenna device 108 is configured to increase the electrostatic capacitance between the antenna element 120 and the ground element 130 by forming both the antenna element 120 and the ground element 130 inside a multilayer printed-wiring board 116. It may be possible to form one of the antenna element 120 and the ground element 130 inside the printed-wiring board 116.

Figure 34:
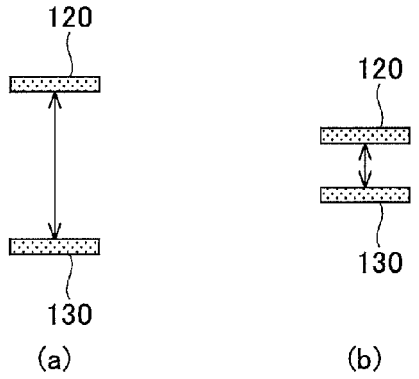
FIG. 34 schematically illustrates a part of the antenna device of the First Embodiment.

Referring to FIG. 34, in the antenna device 108, the interval (the distance) between the antenna element 120 and the ground element 130 can be reduced by using the printed-wiring board 116. With this, the electrostatic capacitance between the antenna element 120 and the ground element 130 can be increased. Referring to (a) of FIG. 34, the antenna element 120 and the ground element 130 are formed on both sides of the printed-wiring board. Since the interval between the antenna element 120 and the ground element 130 are great, the electrostatic capacitance is not so large. On the contrary thereto, referring to (b) of FIG. 34, the antenna element 120 and the ground element 130 are formed inside the printed-wiring board 116. The interval between the antenna element 120 and the ground element 130 are narrowed to thereby increase an electrostatic capacitance.

Figure 35:
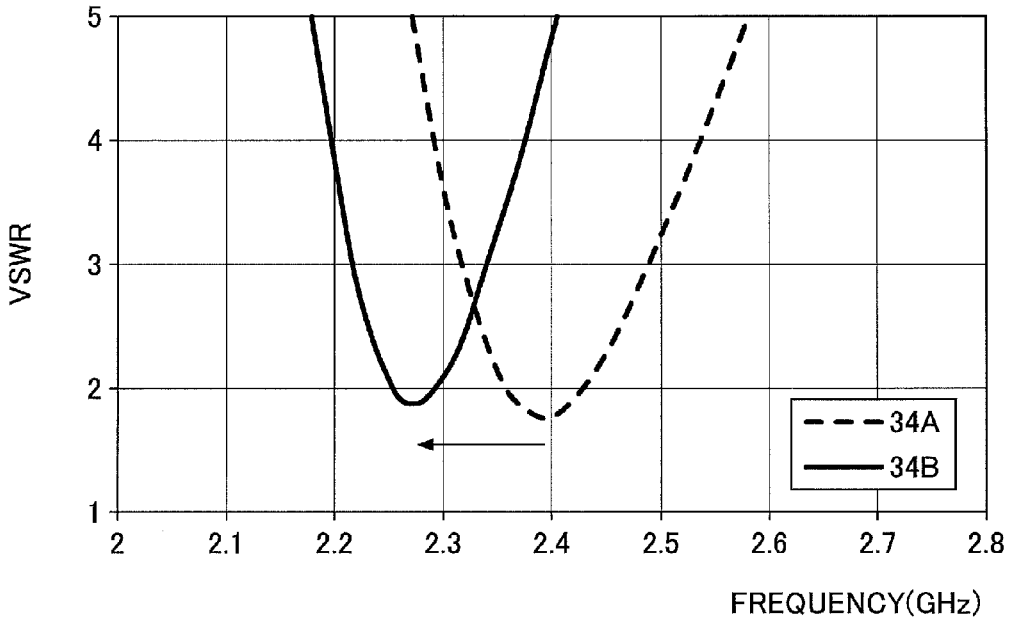
FIG. 35 is a VSWR characteristic diagram of the circuit board of the Fifth Embodiment.

FIG. 35 illustrates VSWR characteristics in the antenna device 108. The VSWR characteristics of the antenna device illustrated in FIG. 34(*a*) are indicated by 34A, and the VSWR characteristics of the antenna device illustrated in FIG. 34(*b*) are indicated by 34B. Referring to FIG. 35, by increasing the electrostatic capacitance between the antenna element 120 and the ground element 130, the frequency range can be shifted to make the value of VSWR as small as possible. As described, when the value of the electrostatic capacitance is changed by narrowing the interval between the antenna element 120 and the ground element 130, it is possible to shift the frequency range without substantially changing the frequency range. The other portions are the same as those in the First Embodiment.

Sixth Embodiment

The Sixth Embodiment is described next. The antenna device 109 is formed to set to a predetermined frequency range by increasing an inductance without widening an area where an antenna element 126 or the like is formed and lowering the frequency range to thereby set to a predetermined frequency range.

Figure 36:
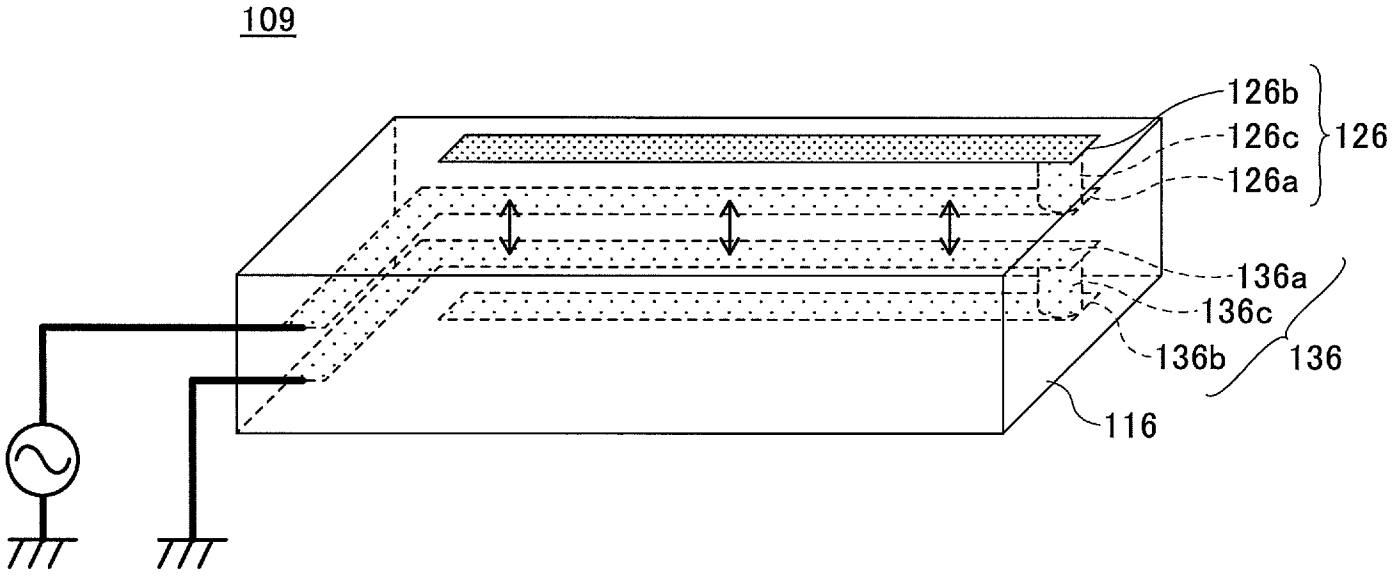
FIG. 36 illustrates a structure of an antenna device of a Sixth Embodiment.

The structure of the antenna device 109 of the Sixth Embodiment is illustrated in FIG. 36. In the antenna device 109, a multilayer printed-wiring board 116 is used, and the antenna element 126 and the ground element 136 are multilayered. The antenna element 126 includes a first antenna element 126*a* formed inside the printed-wiring board 116 and a second antenna element 126*b* formed on one of surfaces of the printed-wiring board 116. The first antenna element 126*a* and the second antenna element 126*b* are connected by an antenna element connecting portion 126*c* formed inside a throughhole for connecting the first antenna element 126*a* and the second antenna element 126*b*.

The ground element 136 includes a first ground element 136*a* formed inside the printed-wiring board 116 and a second ground element 136*b* formed on the other one of surfaces of the printed-wiring board 116. The first ground element 136*a* and the second ground element 136*b* are connected by a ground element connecting portion 136*c* formed inside a throughhole for connecting the first ground element 136*a* and the second ground element 136*b*.

Within the Sixth Embodiment, without expanding an area inside the printed-wiring board 116 where the antenna element 126 or the like is formed, the inductances of the antenna element 126 and the ground element 136 can be increased.

Figure 37:
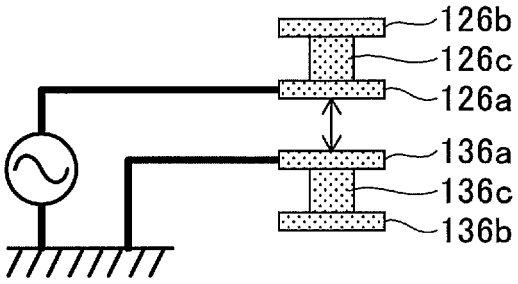
FIG. 37 schematically illustrates a part of the antenna device of the Sixth Embodiment.

Referring to FIG. 37, a cross-sectional view of an arrangement of the antenna element 126 and the ground element 136 of the antenna device illustrated in FIG. 36 is schematically illustrated. The antenna element 126*a*, the second antenna element 126*b*, the first ground element 136*a* and the second ground element 136*b* are formed so that these entire areas overlap in the thickness direction of the antenna device 109. Thus, when a high frequency electric signal is applied to the antenna element 126, the antenna element 126 can be excited while the antenna elements match in the thickness direction of the printed-wiring board 116.

Figure 38:
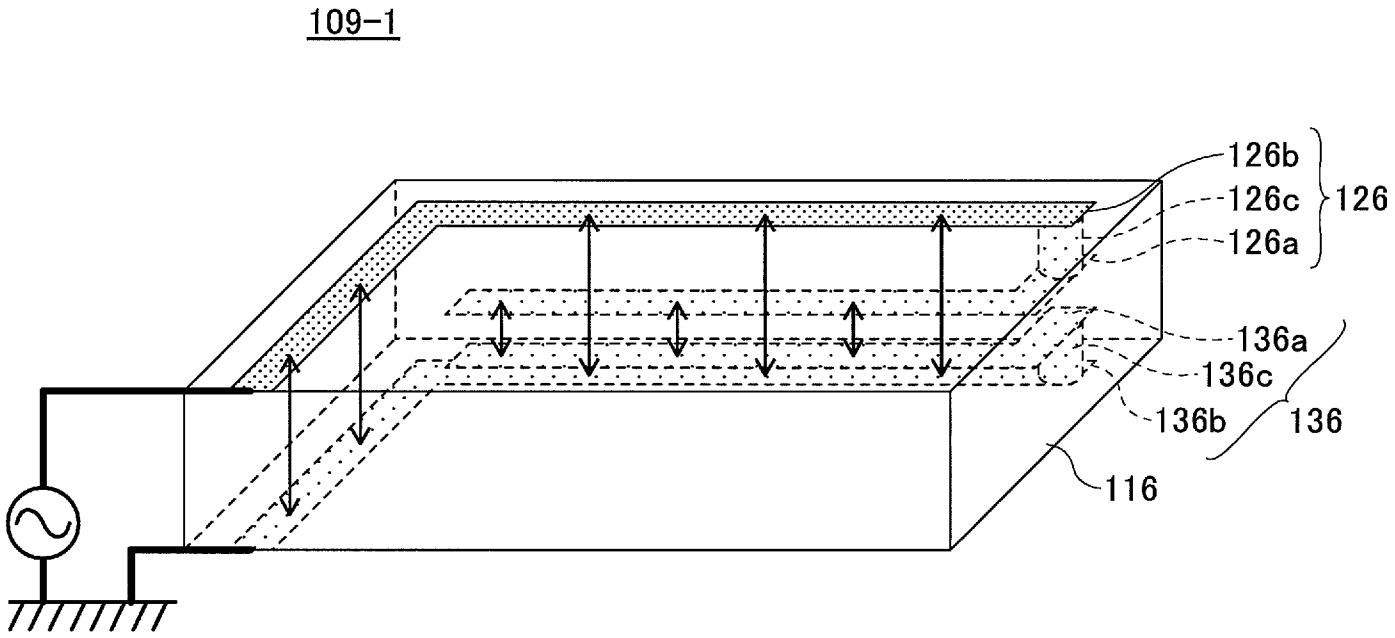
FIG. 38 schematically illustrates a first structure of another antenna device of the Sixth Embodiment.
Figure 39:
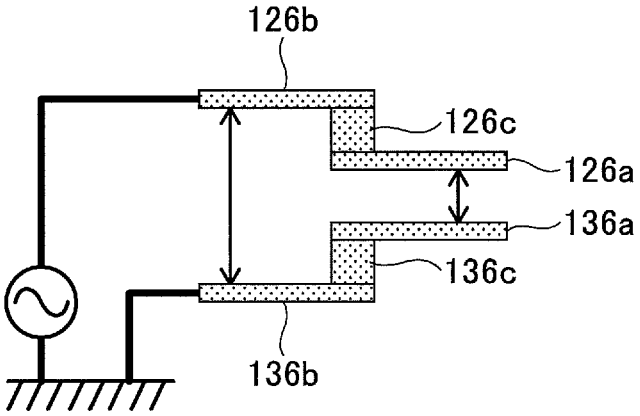
FIG. 39 schematically illustrates a part of the first structure of the other antenna device of the Sixth Embodiment.

Referring to FIG. 38, an antenna device 109-1 may have areas which do not overlap in the thickness direction of a printed-wiring board 116 by shifting positions of a first antenna element 126*a* and a second antenna element 126*b* and positions of a first ground element 136*a* and a second ground element 136*b*. In this case, an electromagnetic field may leaks from the shifted areas of the first and second antenna elements and of the first and second ground element. Referring to FIG. 39, a cross-sectional view of an arrangement of the antenna element 126 and the ground element 136 of the antenna device illustrated in FIG. 38 is schematically illustrated.

Figure 40:
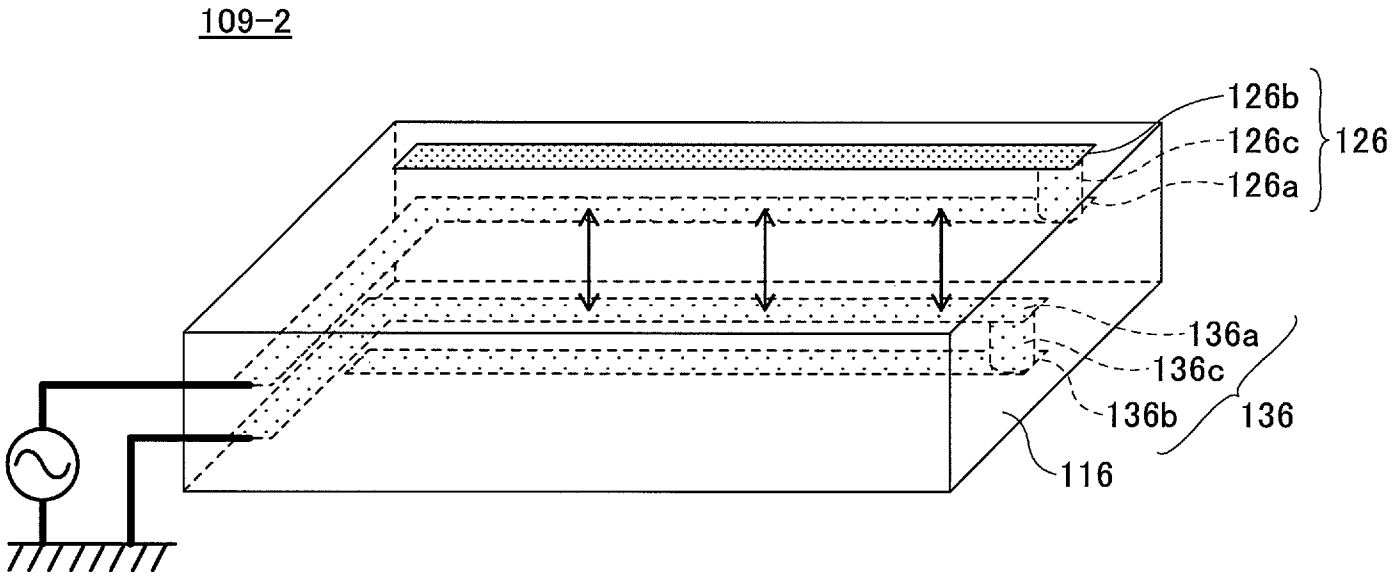
FIG. 40 schematically illustrates a second structure of another antenna device of the Sixth Embodiment.
Figure 41:
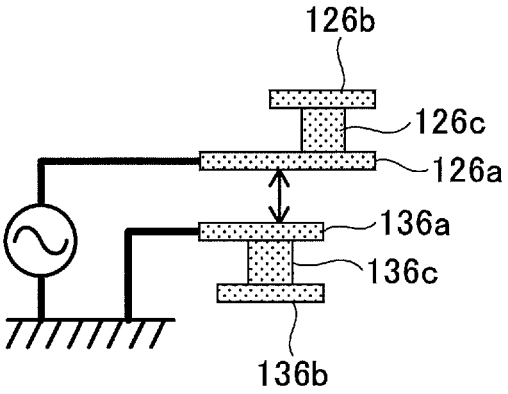
FIG. 41 schematically illustrates a part of the second structure of another antenna device of the Sixth Embodiment.

Further, referring to FIG. 40, it is also possible to provide an antenna device 109-2 in which an antenna element 126 shifts from a ground element 136 so as to form areas not overlapping each other. In this case, an electromagnetic field may leak from the shifted areas of first and second antenna elements and of first and second ground element. Referring to FIG. 41, a cross-sectional view of an arrangement of the antenna element 126 and the ground element 136 of the antenna device illustrated in FIG. 40 is schematically illustrated.

When the inductance is increased in the antenna device, the meander patterns of the antenna elements and the ground elements are formed on both surfaces of the printed-wiring board 110 as in the antenna device of the Fourth Embodiment. However, within the Sixth Embodiment, the inductance can be increased without expanding the areas where the antenna element and the ground elements are formed in comparison with the antenna device with the meander pattern. Thus, the antenna device can be formed within a more narrow area. The other portions are the same as those in the First Embodiment.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of superiority or inferiority of the invention. Although the embodiments of the present invention have been described in detail, it should be understood that the various changes, substitutions, and alterations could be made hereto without departing from the spirit and scope of the invention.

What is claimed is:

1. An antenna device comprising:

a multi-layered printed wiring board made of a dielectric material;

an antenna element formed on the multi-layered printed wiring board; and a ground element formed on the multi-layered printed wiring board, wherein a shape of the antenna element and a shape of the ground element are an inverse L shape, and a position of the antenna element and a position of the ground element are plane-symmetric with respect to the multi-layered printed wiring board, wherein the shape and the position of the antenna element and the shape and the position of the ground element overlap in a planar view of the multi-layered printed wiring board along a thickness direction of the multi-layered printed wiring board, and wherein one or both of the antenna element and the ground element are formed inside the multi-layered printed-wiring board.

2. An antenna device comprising:

a multi-layered printed wiring board made of a dielectric material; an antenna element that includes a first antenna element formed inside the multi-layered printed-wiring board, and a second antenna element formed on a first surface of the multi-layered printed-wiring board, and an antenna element connecting portion interposed between the first antenna element and the second antenna element to directly connect the first antenna element with the second antenna element, the antenna element connecting portion being formed in the multi-layered printed wiring board; and a ground element that includes a first ground element formed inside the multi-layered printed-wiring board, a second ground element formed on the other surface of the multi-layered printed-wiring board, and a ground element connecting portion interposed between the first ground element and the second ground element to directly connect the first ground element with the second ground element, the ground element connecting portion being formed in the multi-layered printed wiring board, wherein a shape of each of the first antenna element, the second antenna element, the first ground element, and the second ground element are the same, and the first antenna element, the second antenna element, the first ground element, and the second ground element are positioned to be plane-symmetric with respect to the multilayered printed wiring board from each other.

3. The antenna device according to claim 2, wherein the first antenna element and the first ground element are formed in a region where the second antenna element overlaps the second ground element through a thickness of the multi-layered printed wiring board.

4. The antenna device according to claim 2, wherein any one of the first antenna element, the second antenna element, the first ground element and the second ground element does not overlap another one of the first antenna element, the second antenna element, the first ground element and the second ground element through a thickness of the multi-layered printed wiring board.

5. The antenna device according to claim 2, wherein the shape of each of the first antenna element, the second antenna element, the first ground element, and the second ground element are an inverse L shape.

* * * * *